US007280438B2

(12) United States Patent
Fujisawa

(10) Patent No.: US 7,280,438 B2
(45) Date of Patent: Oct. 9, 2007

(54) ELECTRONIC TIMEPIECE WITH AN INTERNAL ANTENNA

(75) Inventor: Teruhiko Fujisawa, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 173 days.

(21) Appl. No.: 10/897,686

(22) Filed: Jul. 23, 2004

(65) Prior Publication Data

US 2005/0018543 A1 Jan. 27, 2005

(30) Foreign Application Priority Data

Jul. 25, 2003 (JP) ..... 2003-201832
May 11, 2004 (JP) ..... 2004-141537

(51) Int. Cl.
*G04C 11/02* (2006.01)

(52) U.S. Cl. ..... 368/47; 343/720

(58) Field of Classification Search ..... 368/10, 368/13, 47, 276, 278; 343/720, 732, 787, 343/788

See application file for complete search history.

(56) References Cited

U.S. PATENT DOCUMENTS

| | | | | |
|---|---|---|---|---|
| 5,742,564 | A | 4/1998 | Kuschel et al. | |
| 5,768,217 | A * | 6/1998 | Sonoda et al. | 368/10 |
| 6,134,188 | A | 10/2000 | Ganter et al. | |
| 6,934,222 | B2 * | 8/2005 | Fujimori | 368/204 |
| 6,992,952 | B2 * | 1/2006 | Endo et al. | 368/10 |

FOREIGN PATENT DOCUMENTS

| | | |
|---|---|---|
| DE | 44 07 116 | 9/1995 |
| DE | 296 07 866 | 8/1997 |
| EP | 1 420 476 | 5/2004 |
| JP | 8-30741 | 11/1996 |
| JP | 11-64547 | 3/1999 |
| JP | 2000-105285 | 4/2000 |
| JP | 2001-33571 | 2/2001 |
| JP | 2001264463 | 9/2001 |
| JP | 2001-272482 | 10/2001 |
| JP | 2003-35787 | 2/2003 |
| JP | 2003-121569 | 4/2003 |
| WO | 9527928 | 10/1995 |

* cited by examiner

*Primary Examiner*—Vit Miska
*Assistant Examiner*—Sean Kayes

(57) ABSTRACT

A radio-controlled timepiece with an internal antenna provides an improved arrangement within and appearance to a case member of the timepiece that reduces manufacturing cost and affords a smaller timepiece. The antenna, which has a core and coil wound around the core, is rendered inside the case member such that both end portions of the core, and preferably the entire core, are disposed along a curved inside surface of the case member. Because the end surfaces of the core do not oppose the inside surface, the antenna can be located close to the case member without a drop in antenna performance. The case member can therefore be made of metal to give the timepiece a better design and appearance. With such an arrangement, production cost can be reduced because notches need not be formed in the case, and the timepiece can be made smaller.

11 Claims, 19 Drawing Sheets

(A)

(B)

| Reception frequency | 40 kHz | 60 kHz | 77.5 kHz |
|---|---|---|---|
| Switch 223 | off | on | on |
| Inductance | La+Lb | La | La |
| Switch 224 | on | on | off |
| Electrostatic capacitance | C1+C2 | C1+C2 | C1 |

FIG. 13

ELECTRONIC TIMEPIECE WITH AN INTERNAL ANTENNA

BACKGROUND OF THE INVENTION

1. Field of the Invention

The present invention relates to an electronic timepiece with an internal antenna such as a radio-controlled timepiece that receives external wireless information including time information and adjusts the displayed time accordingly.

2. Description of the Related Art

Electronic timepieces with an internal antenna, such as radio-controlled watches that adjust the displayed time based on time information received from an external source, are known from the literature. See, for example, Japanese Unexamined Patent Appl. Pub. 2003-161788.

In such an electronic timepiece the internal antenna is housed in a first watch case made of plastic or other non-conductive material. The first watch case is covered with a metal second watch case that has a notch formed in a portion thereof. The opening of the antenna loop is rendered opposite this notch so that radio signals can be received by the antenna without being blocked by the metal case.

While watches of this type can thus have a metal exterior and accordingly a high quality appearance, two different cases made of different materials are required, and a notch must be formed in the conductive case. Manufacturing is thus more difficult, and the production cost is therefore higher.

There are also electronic timepieces with an internal antenna in which the watch case is plastic. However, such watches, compared with watches having a metal case, have a less attractive design and a low quality appearance.

Furthermore, while a common rod antenna can be rendered inside a metal watch case as taught in the cited Japanese Pub. 2003-161788, this results in a rather large watch case. More specifically, if the ends of the antenna core are close to the inside surface of the case, radio signals are attenuated by the metal case and the reception sensitivity of the antenna thus drops. The antenna core ends must therefore be separated a certain distance from the inside surface of the case. In addition, the antenna must be of a certain minimum length determined by the type of radio signals received. With these constraints, in order to render an antenna of a specific length inside the watch case with the antenna ends separated a certain distance from the inside surface of the case, a larger watch case is required. This is undesirable.

This problem is not limited to radio-controlled timepieces, and is common to all electronic timepieces with an internal antenna for radio communication.

OBJECT OF THE INVENTION

An object of the present invention is therefore to provide an electronic timepiece with an internal antenna whereby the appearance and design of the external case can be improved, manufacturing cost can be reduced, and timepiece size can be reduced.

SUMMARY OF THE INVENTION

A radio-controlled timepiece with an internal antenna according to the present invention comprises a case member of which at least a portion is composed of metal and which has an inner curved surface. The antenna is configured to receive information wirelessly-transmitted from an external source and is disposed in the case member. The timepiece further comprises a receiver for processing the information wirelessly received by the antenna, and a time display. The antenna includes a core having two end portions and a coil wound around the core. In addition, the antenna is positioned in the case member with at least both end portions of the core disposed along, and substantially aligned with, the inner curved surface of the case member.

Positioning the antenna with the end portions along the inner curved surface of the case member means that if the inner curved surface is round, for example, the axis of the core end portion is essentially parallel to the tangent to the inner curved surface at the point adjacent to the core end portion, and if the inner curved surface is polygonal, the axis of the core end portion is essentially parallel to the segment of inner curved surface adjacent to the core end portion. Substantially or essentially parallel is not limited to perfectly parallel where the angle of intersection between these lines is 0 degrees, but rather includes arrangements in which this angle of intersection is in the range of +/−30 degrees from 0 degrees. Preferably, the above-described angle is such that the magnetic field of signals linking to the core is not affected by the inner curved surface of the case.

By positioning at least both of the end portions of the core along the inner curved surface of the case member such that the end surfaces of the core are not opposite the inner curved surface, at least part of the case member can be metal and the antenna can be positioned adjacent to the metal part of the case member.

If at least a portion of the case member is metal, and the ends of the core face and are nearly adjacent to the metal part of the inner surface of the case member, radio signals will be attenuated by the case and reception sensitivity will drop several decibels. The ends of the core could be separated from the case member by shortening the antenna, but if the antenna is disposed inside a small case member such as that of a wristwatch, the antenna becomes so short that performance drops.

The present invention solves this problem by positioning both end portions of the core along the inner surface of the case member, and more specifically so that the axes of the end portions of the core are substantially parallel to the inner surface of the case member adjacent to the core end portions. The end surfaces of the core can therefore be separated a certain distance from case member even if the end portions of the core are disposed beside the inner surface of the case member. Loss of antenna reception sensitivity can therefore be suppressed even if the case member is metal, and because a certain antenna length can be assured, a drop in antenna characteristics can be prevented and a small wristwatch can be provided.

Furthermore, being able to use a metal case means that it is not necessary to use a double case or form notches in the case, and the manufacturing cost can therefore be reduced.

Furthermore, if metal is used in at least part of the case member, particularly on its exterior surface, such as when a metal coating is applied to a plastic case, a radio-controlled watch with an internal antenna having high quality appearance and design can be achieved.

In a radio-controlled timepiece with an internal antenna according to the present invention, at least some of the circuit elements of the receiver are preferably disposed in a space defined by an inner surface of the antenna and an imaginary line extending between end surfaces of both end portions of the core.

If the inner curved surface of the case member is a circular surface, for example, a conventional antenna with a basically straight core cannot be rendered along the inside surface of the case, and even if the antenna is located as closely as possible to the inside surface of the case member, dead space necessarily results between the antenna and the inside case surface. This dead space is too small for locating other circuit elements and is thus not used; it is therefore simply wasted space. Furthermore, even if some circuit elements were to be located in this dead space, the conductors for electrically connecting the circuit elements therein to other circuit elements located in another space on the opposite side of the antenna from this dead space must cross the antenna. The wiring thus becomes complicated.

The present invention solves this problem by rendering the end portions of the core along the inner curved surface of the case member. Compared with the prior art, the entire antenna of this invention can therefore be easily located along the inner curved surface, substantially or completely eliminating this dead space and eliminating wasted space.

Furthermore, since the space available for circuit elements and other components is increased by the amount this dead space is reduced, this invention advantageously increases the use of the limited space available inside the case member. A smaller case member can therefore be used to contain the same circuit elements contained in a timepiece according to the prior art. Furthermore, by minimizing or eliminating the dead space as the present invention does, the conductors for electrically connecting circuit elements do not need to cross the antenna, and wiring is therefore simplified.

Furthermore, by rendering a portion of the circuit elements of the receiver, such as the tuning capacitors and receiver IC, in the space formed between the core and an imaginary line joining both ends of the core, the wiring electrically connecting the antenna and receiver can be shortened. There is thus less chance of electromagnetic noise being picked up by these conductors, thereby enabling better signal reception.

Further preferably, at least both end portions of the coil are disposed along the inner curved surface of the case member.

If the coil is wound around only a part of the middle portion of the core, and more specifically if the coil is wound around half or less of the total length of the core, the ends of the coil may be positioned opposing the metal case even if both end portions of the core are located along the inside surface of the case. In this case antenna characteristics deteriorate because the case interferes with the field linking directly to the coil rather than the ends of the core.

The present invention also solves this problem by rendering both end portions of the coil along the inner curved surface of the case. The case therefore does not interfere with the field linking directly to the coil, and antenna characteristics can be improved accordingly.

If the coil is wound around both end portions of the core and disposed along the inner curved surface, the end portions of the coil are generally also disposed along that surface. Coil length can therefore be maximized and antenna characteristics improved while minimizing the space occupied by the antenna.

It should be noted that when winding the coil around the end portions of the core, it is difficult to wind the coil to the edge of the core ends. The coil is therefore generally wound to a point a few millimeters from the end of the core. If the coil can be wound completely to the ends of the core, then the coil may be wound to both ends of the core.

Furthermore, since the core and coil and axially aligned, if the inner curved surface of the case is circular, the axes of the end portions of the coil are preferably substantially parallel to the corresponding tangents to the inner curved surface adjacent to the end portions of the coil.

Further preferably, the inner curved surface of the case member is a circular surface; and the plane shape of the core is a circular arc substantially concentric to the inner curved surface, and the core is disposed along the inner curved surface of the case member.

With this implementation the entire length of the antenna—both the core and coil—can be rendered to conform to the shape of the case member, and more space can be provided inside the case for housing the movement and other components. Space inside the case can therefore be used more effectively, and a smaller timepiece can be provided.

In a further implementation of the invention the inner curved surface of the case member is a circular surface, and the planar shape of the core is in the form of a circular arc substantially concentric with the inner curved surface. A middle portion of the core has a circular arc shape with the coil wound thereto and connects the end portions. In addition, the curvature of the middle portion is less than the curvature of the end portions.

Because the curvature of the middle portion of the core to which the coil is wound is small and closer to a straight line, winding the coil is easier in this implementation of the invention. Coil winding efficiency can therefore be improved, and the antenna can be manufactured more easily.

In a further implementation of the invention the inner curved surface of the case member is a circular surface; and the planar shape of the core includes end portions having a circular arc shape substantially concentric to the inner curved surface of the case member, and a middle portion with a circular arc shape connecting the end portions and having the coil wound thereto. In addition, the inside and outside contours of the plane of the middle portion are substantially circular arcs, with the center of curvature of the outside contour being at a position farther from the middle portion than the center of curvature of the inside contour.

When the inside and outside contours of the middle portion are concentric, the length of the inside contour is shorter than the length of the outside contour, and the curvature of the inside contour is also greater. Therefore, even if the coil wire is wound with gaps between conductors at the inside contour of the core, gaps appear between conductors along the outside contour, and winding efficiency drops.

By making the curvature of the outside contour of the middle portion less than it would be if the inside and outside contours were both concentric, this invention reduces the difference in the lengths between the inside and outside contours, and depending upon the specific curvatures, the lengths of the inside and outside contours can be made substantially equal. Furthermore, because the curvature of the outside contour is small, it can be made nearly straight. It is therefore easier to wind the coil conductor without gaps along the outside contour. Furthermore, when the coil conductor is wound without gaps along the inside contour of the middle portion of the core, gaps in the coil along the outside contour can be made extremely small or completely eliminated, and winding efficiency is thus improved. Reception sensitivity can therefore be improved by minimizing antenna length.

In another implementation of this invention, the planar shape of the core includes straight end portions, and a middle portion connecting the end portions. The middle portion of the core can be a circular arc formed by a plurality of polygon-shaped straight portions, or a single straight portion connecting the end portions. If at least the end portions are straight, the coil can be easily wound thereto. Furthermore, if the middle portion consists of one or more straight sections, the core can be cut to shape and the coil wound more easily than with a curved core, and overall cost can therefore be reduced.

Yet further preferably, the angle defined by line segments extending from each end surface of the coil to the center point of the inner curved surface of the case member is 60 degrees or more.

The diameter of the inner curved surface of the case member of a typical wristwatch is generally about 30 mm. Therefore, if the coil is wound to a core whose planar shape is that of an arc or polygon segments, the length of the coil (antenna length) is the radius of the arc (approx. 15 mm) times the central angle ($(60/180)\pi$ if 60 degrees), or approximately 15 to 16 mm. To receive a longwave standard time signal (40 to 77.5 kHz), the antenna must be approximately 15 mm. Therefore, if the angle of intersection is 60 degrees or more, the antenna can be used to receive longwave standard time signals, and an effective radio-controlled wristwatch can be realized. Note that if the inner curved surface is a circular arc, then the center of the inside case surface is the center of the circle of which the arc is a part; in the case in which the inner curved surface is a regular polygon, the center of the inside case surface is the center of the circumscribed circle of the regular polygon.

Preferably, when the inner curved surface is a circular surface, the angle of intersection between a widthwise center line substantially perpendicular to an end surface of one end portion of the core and a tangent to the inside circumferential surface at a point on the inner curved surface where a radial line parallel to an end surface of the one end portion and extending from the radial center of the inner curved surface intersects the inner curved surface is in the range of about 0 degrees to about +/−30 degrees.

If the antenna is located proximally to the inside case surface within this angle range, the core ends can be separated a specific distance (approximately several millimeters) from the opposite inside case surface. A drop in reception sensitivity can therefore be prevented and space inside the case can be used effectively.

Using a wristwatch by way of example, if the diameter of the inner curved surface is approximately 30 mm and the antenna core is approximately 3 mm wide, the distance from the widthwise center (approximately 1.5 mm from the inside case surface) of the core to the inside case surface is approximately 6.5 mm when the angle of intersection is 0 deg. This same distance is approximately 2.6 mm if the angle of intersection is +30 deg. A specific space can therefore be formed between the core ends and the inside case surface, the magnetic field of radio signals passing through this space can link to the core ends, and a drop in reception sensitivity can be prevented.

On the other hand, if the angle of intersection is greater than +30 deg, such as +45 deg, the distance to the inside case surface will be approximately 2.0 mm and this space become narrower. Reception sensitivity thus drops accordingly. Furthermore, if the core ends are at more than −30 deg, the core ends will be positioned that much farther toward the center of the case from the inside case surface. This affords less space for housing the movement and other components, and thus inhibits the making of the timepiece smaller.

Thus, not only can space inside the case can be used effectively, but a drop in reception sensitivity can also be prevented by rendering the antenna core within the foregoing angle range.

Note that angles from +1 deg to +30 deg indicate that the core ends are offset toward the inside surface of the case from the position where the core axis is parallel to the corresponding tangent (i.e., the angle of intersection is 0 deg), and angles of −1 deg to −30 deg indicate that the core ends are offset therefrom toward the center of the case member.

Yet further preferably, the core is composed of a magnetic material of layered amorphous foil. The amorphous foil layers can be laminated through the thickness direction of the watch, or through the plane direction (that is, perpendicular to the thickness direction).

Examples of this layered amorphous foil include cobalt-based amorphous metal, iron-based magnetic amorphous metals, and other amorphous metal thin sheets. Using layered amorphous foil as the magnetic core affords a smaller sectional area in the direction of magnetic flux flow, suppresses eddy current caused by flux change, and reduces core loss. Magnetic fields produced by eddy currents can therefore be suppressed, and the reception sensitivity of the antenna can thus be improved.

Furthermore, laminating the amorphous foil in the thickness direction of the watch, that is, in the direction passing through the back cover and crystal of the watch, enables reducing the thickness of the antenna. More specifically, amorphous foil is normally 0.01 mm to 0.05 mm thick, and 10 to 30 amorphous foil layers are generally laminated to make the antenna. The thickness of the core through the layered amorphous foil is therefore at most approximately 1.5 mm. This is significantly thinner than a conventional ferrite core. The thickness of the watch itself can therefore be reduced, thus affording a thin watch with a high quality appearance.

If the amorphous foil is layered through the plane direction of the watch, that is, in the direction perpendicular to the direction through the back cover and crystal, the antenna can be made smaller in the plane direction. The plane area occupied by the antenna inside the watch is therefore reduced, and more space is afforded for installing the movement and other components. Furthermore, if the antenna is formed in a plane circular arc conforming to the internal spacer or inside case surface, the amorphous foil can be easily cut into rectangular pieces that are curved and layered. The antenna can therefore be manufactured easily and efficiently.

Yet further preferably, a radio-controlled timepiece with an internal antenna according to the present invention also has a battery for supplying power. In this case, the antenna is disposed opposite the battery with the center of the inner curved surface of the case member therebetween.

The battery normally has a stainless steel case, and can adversely affect antenna characteristics if located near the antenna. The antenna and battery can be separated by disposing them on opposite sides of the center of the case member. With such an arrangement the battery can be prevented from affecting antenna performance.

Thus, an electronic timepiece with an internal antenna according to the present invention described herein improves the appearance and design of the external case, reduces manufacturing costs, and enables the making of a smaller timepiece.

Other objects and attainments together with a fuller understanding of the invention will become apparent and appreciated by referring to the following description and claims taken in conjunction with the accompanying drawings.

BRIEF DESCRIPTION OF THE DRAWINGS

FIG. 13 is a table showing the correlation between the reception frequency and on/off states of the switches shown in FIG. 12;

DESCRIPTION OF THE PREFERRED EMBODIMENTS

Figure 1:
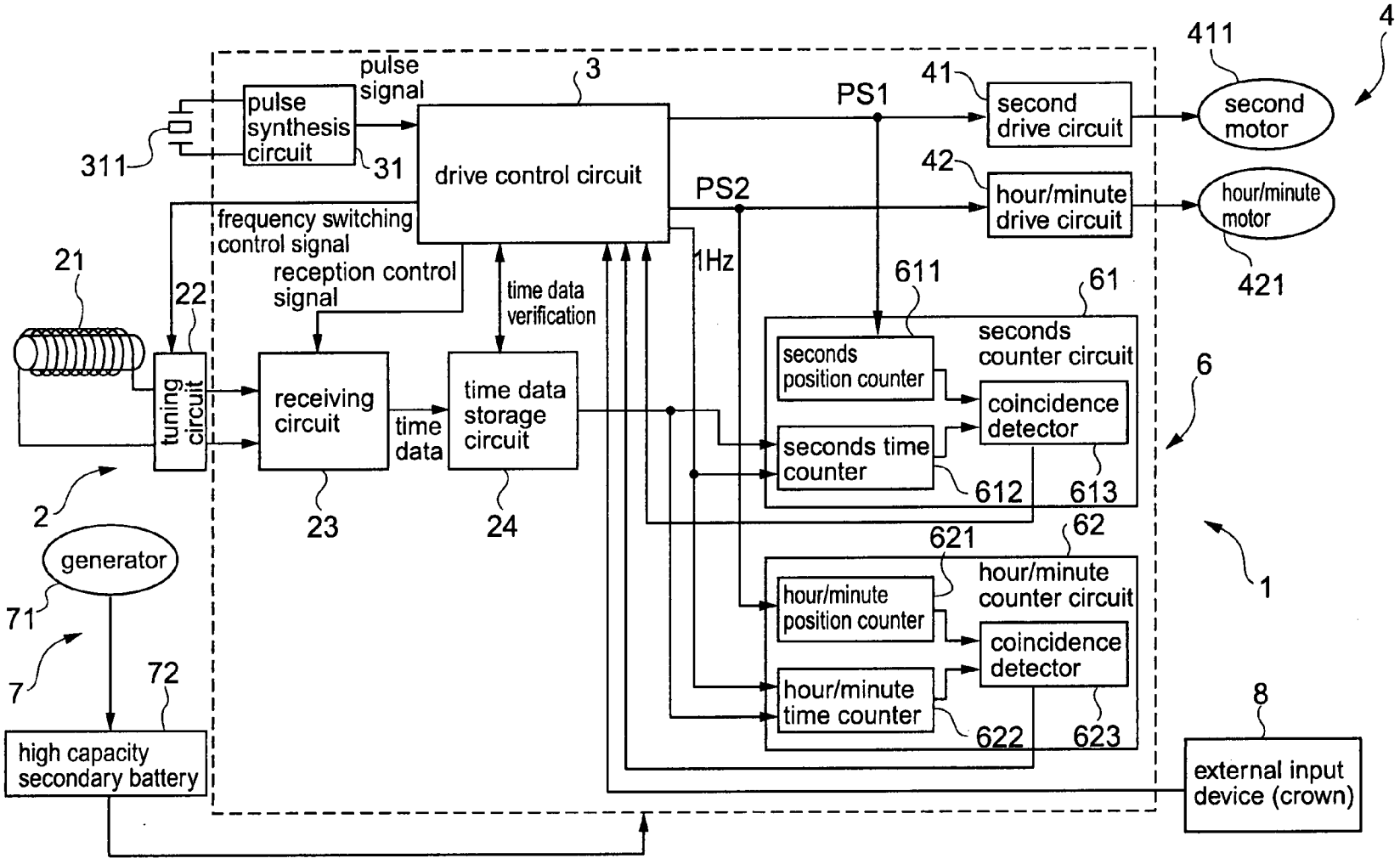
FIG. 1 is a block diagram of a first embodiment of the present invention.

Preferred embodiments of the present invention are described below with reference to the accompanying figures. It should be noted that like parts are identified by the same reference numerals in the following figures and embodiments, and subsequent description thereof is simplified or omitted.

First Embodiment

FIG. 1 is a block diagram showing the configuration of a radio-controlled watch 1 as a first embodiment of an electronic timepiece with an internal antenna according to the present invention.

This radio-controlled watch 1 has the same basic configuration as a common radio-controlled timepiece, including a receiver 2 as a communication device for receiving a time code signal (external wireless information), a drive control circuit 3 as the drive controller, a driver 4 for driving the hands, a counter 6 for keeping time, a power supply 7 for supplying power, and an external input device 8 such as a crown.

The receiver 2 comprises an antenna 21 for receiving radio signals, a tuning circuit 22 including a capacitor for tuning the receiver to the radio signal received by the antenna 21, a receiving circuit 23 for processing information received by the antenna 21, and a time data storage circuit 24 for storing the time data processed by the receiving circuit 23.

Figure 2:
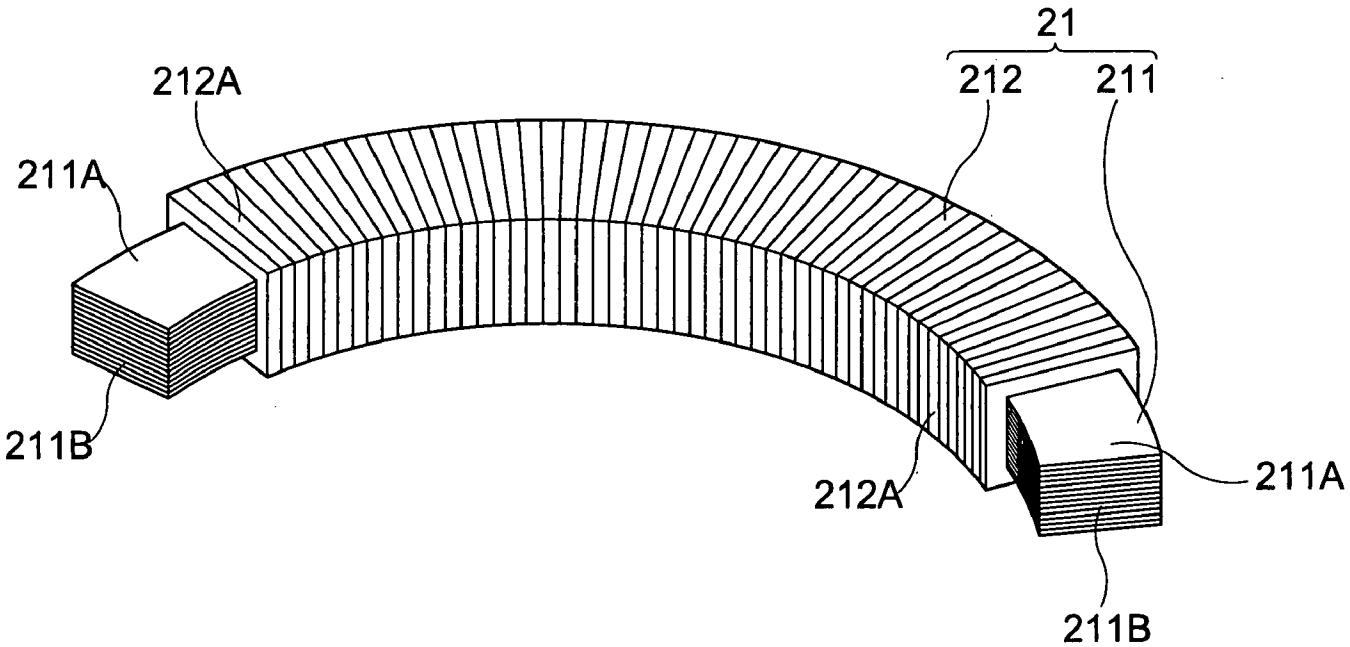
FIG. 2 is an oblique view showing the configuration of an antenna in a preferred embodiment of the invention.

As shown in FIG. 2, the antenna 21 includes a coil 212 wound around a magnetic core 211. The antenna 21 may be insulated as needed with a cationic electrodeposition coating affording outstanding corrosion resistance.

The magnetic core 211 is made by adhesively bonding from 10 to 30 layers of die-stamped or etched cobalt-based amorphous foil (such as an amorphous foil containing 50 wt % or more of Co) pieces, and then stabilizing the magnetic characteristics by annealing or other heat treatment process. More specifically, the magnetic core 211 is composed of multiple circular arc-shaped amorphous foil pieces layered together in the thickness direction of the timepiece. It should be noted that this magnetic core 211 is not limited to a layered amorphous foil construction, and could be made from ferrite. If made from ferrite, for example, the core could be cast in a mold and then heat treated.

Each of the amorphous foil layers of this magnetic core 211 is 0.01 mm to 0.05 mm thick. If the core has 30 layers, for example, the resulting magnetic core 211 will be 0.3 mm to 1.5 mm thick through the lamination direction.

Amorphous materials have better magnetic characteristics than ferrite, and therefore afford a smaller, thinner antenna 21. Furthermore, because antenna characteristics are affected by the volume of the core, the plane area of the antenna must be increased or the antenna length (core length) must be increased in order to maintain the same antenna performance when the antenna thickness is reduced. The width of the magnetic core 211 is therefore approximately 0.5 mm to 3.0 mm, and the length is approximately 15 mm to 30 mm, in this preferred embodiment of the invention.

Note that when the thickness of an amorphous metal sheet is thicker than 0.05 mm, rapid cooling in the middle of the sheet thickness becomes difficult, and the metal therefore crystallizes rather than solidifying in an amorphous state. In other words, rapid cooling is needed before the metal crystallizes in order to produce an amorphous metal, and the thickness of the metal must therefore be very thin. In addition, if the thickness of the amorphous metal sheet is thinner than 0.01 mm, the strength of the amorphous metal sheet will be weakened to the point that it deforms easily during the assembly process, and both handling and positioning the parts become extremely difficult.

In order to receive a standard longwave time code signal of 40 kHz to 77.5 kHz, the coil 212 requires inductance of approximately 10 mH. In this embodiment of the invention the coil 212 is wound several hundred turns with approximately 0.1 μm diameter polyurethane coated magnet wire. Furthermore, to simplify winding the coil 212 and to prevent the end from unraveling, the coil 212 is not wound to the ends 211B of the core 211, but rather is wound to a position a specific distance (typically a few millimeters) from the ends 211B of the core 211. There is, therefore, a part to which coil 212 is not wound at the end portions 211A of the core 211.

Winding the coil 212 is not limited to any particular method. The coil 212 could be randomly wound, but regular winding is preferred. Regular winding eliminates wasted space between the coil wires, and reduces the coil volume needed to achieve the same inductance. Because the core 211 is a flat arc in this embodiment of the invention, the antenna 21 is manufactured as described below.

A self-fusing wire coil is first wound to the core, and the coil is then fixed by heat or immersion in an appropriate solution. After the coil is fixed, the bobbin is removed. The magnetic core 211 is then inserted to the through-hole formed by removing the bobbin. Note that the antenna could also be formed by inserting the core to the bobbin to which the coil is wound. This increases the size of the antenna by the size of the bobbin, but makes it easier to manufacture the antenna.

Figure 3:
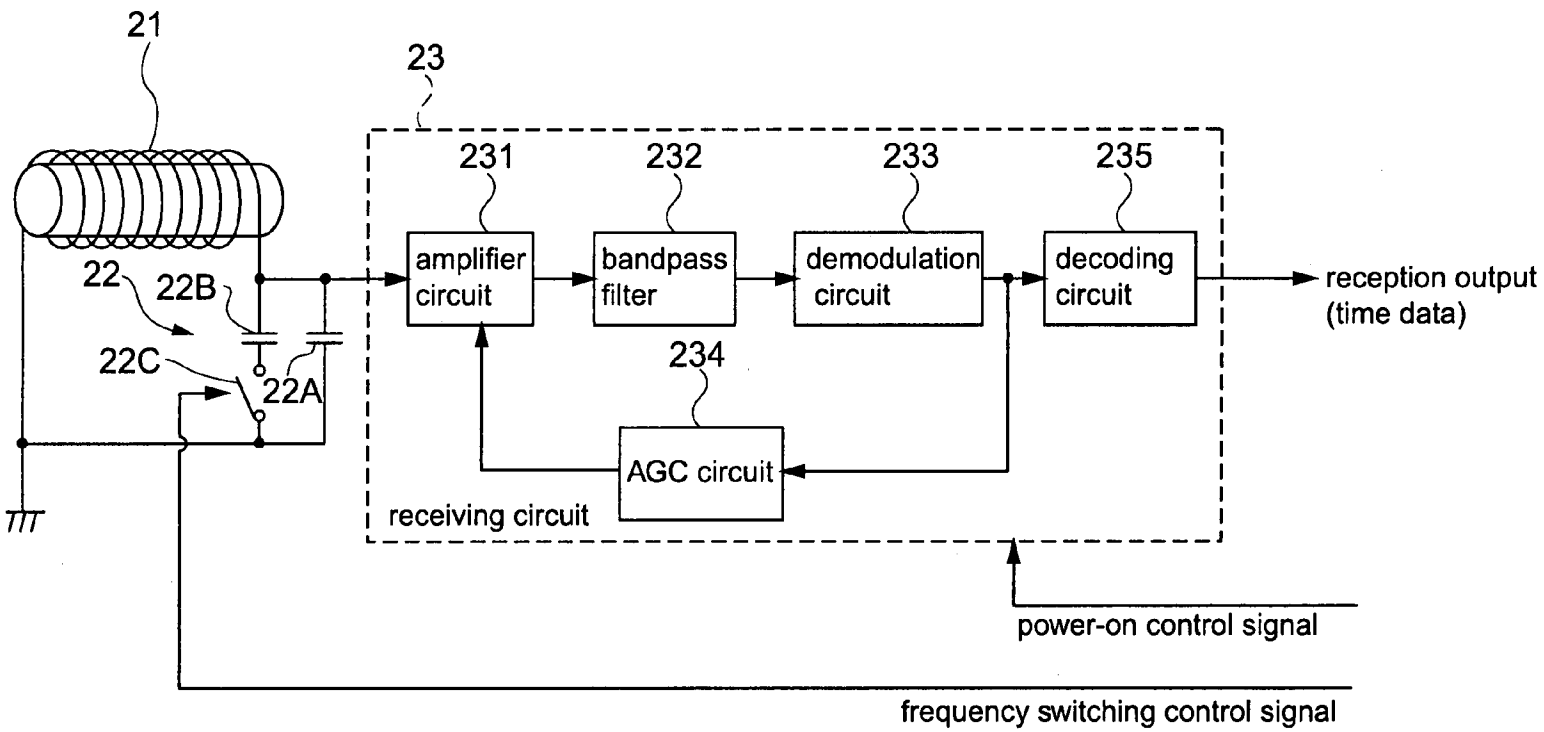
FIG. 3 is a block diagram showing a receiver circuit in a preferred embodiment of the invention.

As shown in FIG. 3, the tuning circuit 22 includes two capacitors 22A and 22B connected in parallel to the antenna 21 with a switch 22C connected between capacitor 22B and the antenna ground.

A frequency switching control signal output from the drive control circuit 3 controls the opening and closing of switch 22C so that the tuning circuit 22 changes the frequency of the signal received by the antenna 21. In Japan, for example, the standard time signal is broadcast at 40 kHz from Mt. Otakadoya in eastern Japan, and at 60 kHz from Mt. Hagane in western Japan. The tuning circuit 22 in our invention thus enables switching reception to either of these longwave time signals.

As also shown in FIG. 3, the receiving circuit 23 includes an amplifier circuit 231, a bandpass filter 232, a demodulation circuit 233, an AGC circuit 234, and a decoding circuit 235. The amplifier circuit 231 amplifies the longwave time signal received by the antenna 21. The bandpass filter 232 extracts the desired frequency component from the amplified time signal. The demodulation circuit 233 smoothes and demodulates the time signal. The AGC circuit 234 controls the gain of the amplifier circuit 231 to hold the reception level of the longwave standard time signal constant. The decoding circuit 235 then decodes and outputs the demodulated standard time signal.

The time data received by the receiving circuit 23 and processed is then output to and stored in the time data storage circuit 24 as shown in FIG. 1.

The receiving circuit 23 starts receiving the time information based on a received control signal output from the drive control circuit 3 either at a predefined schedule or when reception is forced by operating the external input device 8.

A pulse signal from the pulse synthesis circuit 31 is input to the drive control circuit 3 as shown in FIG. 1. The pulse synthesis circuit 31 frequency divides a reference pulse from a reference oscillator 311 such as a quartz oscillator to generate a clock pulse, and generate pulse signals of varying pulse width and timing from the reference pulse.

The drive control circuit 3 outputs a seconds drive pulse signal PS1 once every second to the second drive circuit 41 to drive the second hand, and an hour/minute drive pulse signal PS2 once every minute to the hour/minute drive circuit 42 to drive the minute and hour hands, and thereby controls driving the watch hands. The drive circuits 41, 42 thus output pulse signals to drive the second motor 411 and, hour/minute motor 421, each of which is a stepping motor, and thereby drive the second hand connected to the second motor 411 and the minute hand and hour hand connected to the hour/minute motor 421. The hands, motors 411, 421, and drive circuits 41, 42 thus constitute a time display for displaying the time. It will also be obvious that the hour hand, minute hand, and second hand can be driven using a single motor to display the time.

The counter 6 includes a seconds counter circuit 61 for counting the seconds, and a hour/minute counter circuit 62 for counting the hour and minute.

The seconds counter circuit 61 includes a seconds position counter 611, seconds time counter 612, and coincidence detector 613. The seconds position counter 611 and seconds time counter 612 are both counters that complete one loop every 60 counts, that is, every 60 seconds when a 1-Hz signal is applied. The seconds position counter 611 counts the drive pulse signal (seconds drive pulse signal PS1) supplied from the drive control circuit 3 to the second drive circuit 41. By thus counting the drive pulse signal that drives the second hand, the position of the second indicated by the second hand is also counted.

The seconds time counter 612 normally counts a 1-Hz reference pulse signal (clock pulse) output from the drive control circuit 3. Furthermore, when a time signal is received by the receiver 2, the counter is adjusted to the second value in the received time signal.

The hour/minute counter circuit 62 likewise has a hour/minute position counter 621, hour/minute time counter 622, and coincidence detector 623. The hour/minute position counter 621 and hour/minute time counter 622 are both counters that loop once when signals for a 24-hour period are input. The hour/minute position counter 621 counts the drive pulse signal (hour/minute drive pulse signal PS2) supplied from the drive control circuit 3 to the hour/minute drive circuit 42, and thus counts the positions of the hour hand and minute hand.

The hour/minute time counter 622 counts the 1-Hz pulse signal (clock pulse) output from the drive control circuit 3 (or more precisely, counts 1 each time it counts 1 Hz 60 times). When a time signal is received by the receiver 2, the counter adjusts to the hour/minute data in the time signal.

The coincidence detectors 613, 623 detect whether the counts of the respective position counters 611, 621 and time counters 612, 622 match, and supply a detection signal indicating whether the counts match to the drive control circuit 3.

If the coincidence detectors 613, 623 output a mismatch signal, the drive control circuit 3 continues to output the drive pulse signals PS1, PS2 until a match signal is received. Therefore, during normal operation of the movement when the time counters 612, 622 increment based on the 1-Hz reference signal from the drive control circuit 3 and no longer match the position counters 611, 621, the drive pulse signals PS1, PS2 are output and the hands move so that the position counters 611, 621 again match the time counters 612, 622. The movement and timekeeping are thus controlled by simply repeating this operation.

Furthermore, when the time counters 612, 622 are adjusted based on the received time signal, the drive pulse signals PS1, PS2 are output continuously to rapidly advance the hands to show the correct time, which is determined by the current counts of the position counters 611, 621 matching the counts of the time counters 612, 622.

The power supply 7 includes a generator 71 such as a self-winding generator or solar cell (solar power generator), and a high capacity secondary battery 72 for storing the power generated by the generator 71. The high capacity secondary battery 72 is a secondary cell such as a lithium ion battery. The power supply 7 could also be a primary cell such as a silver-oxide battery.

The external input device 8 includes a crown, for example, and is used to force time signal reception and to set the time.

Construction of the radio-controlled watch 1 is described next.

Figure 4:
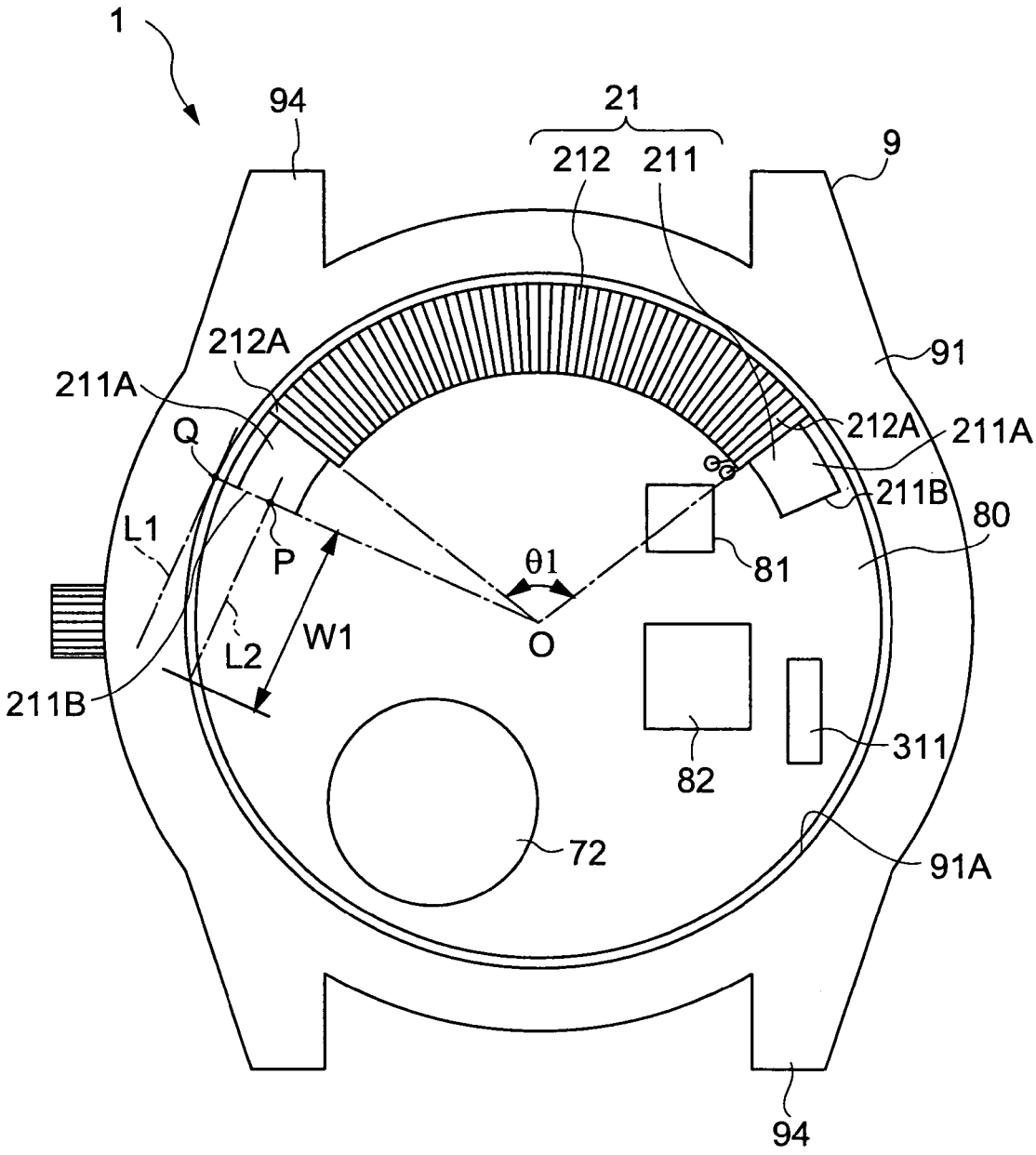
FIG. 4 is a schematic plan view of a timepiece in a preferred embodiment of the invention.
Figure 5:
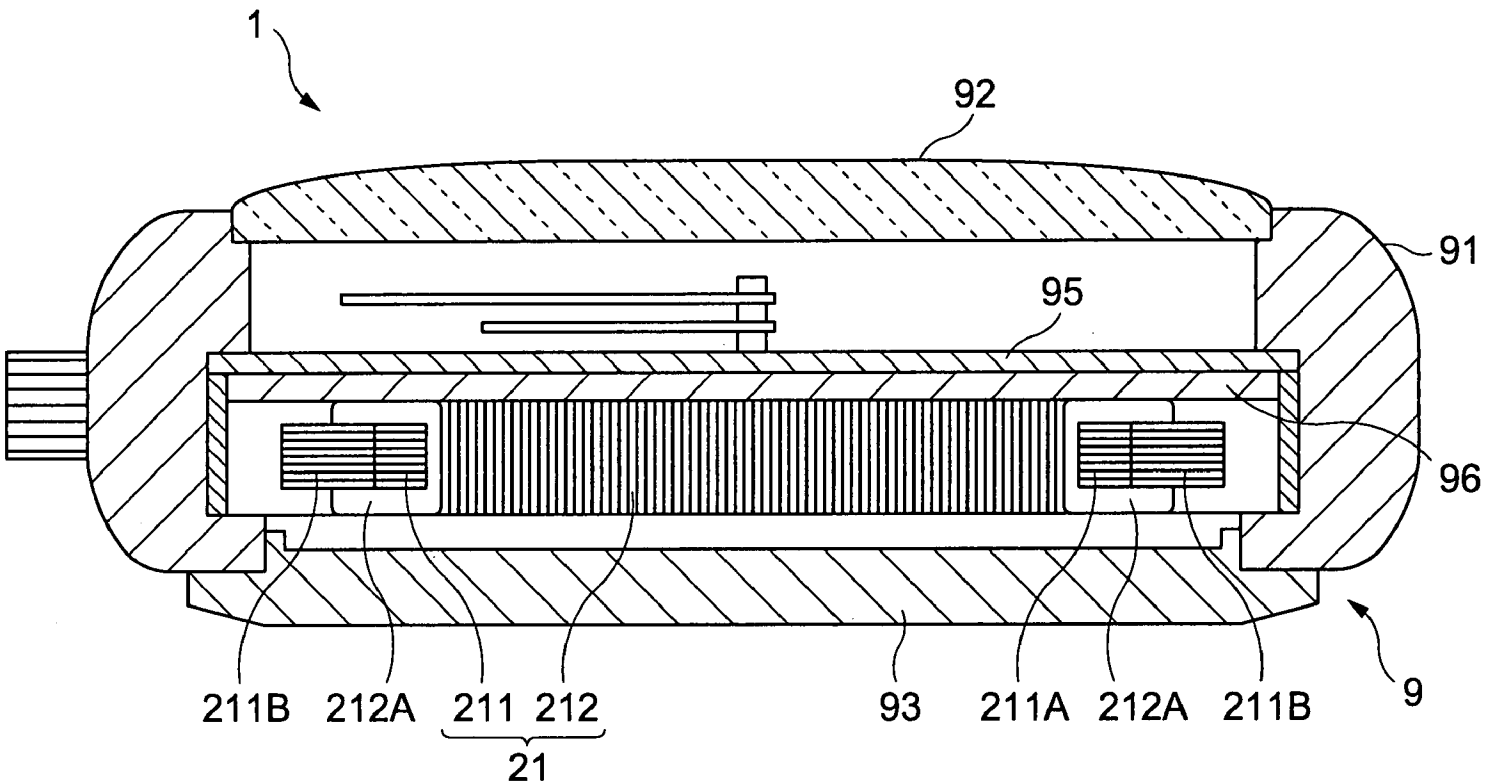
FIG. 5 is a schematic section view of a timepiece in a preferred embodiment of the invention.
Figure 6:
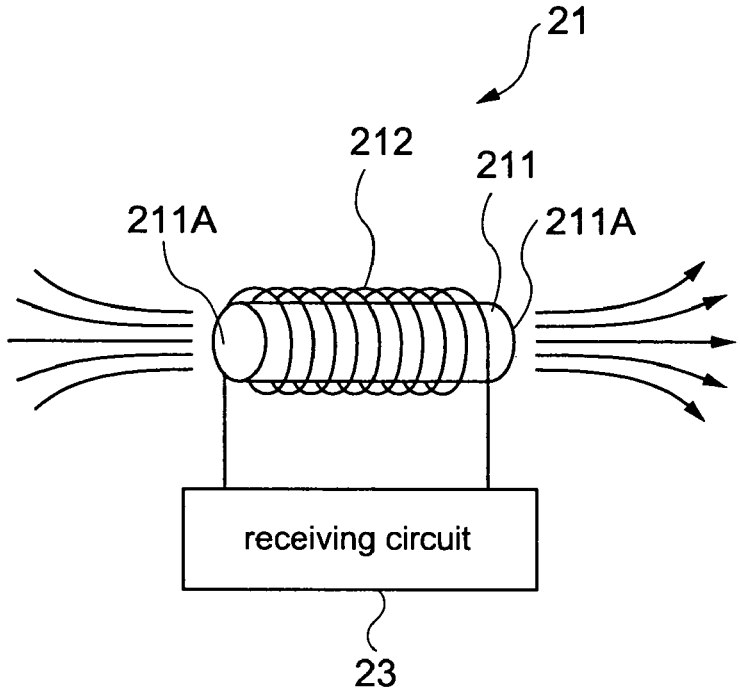
FIG. 6 illustrates signal reception by an antenna.

As shown in FIG. 4 and FIG. 5, this radio-controlled watch 1 has a substantially ring-shaped casing 91, a crystal 92 mounted on the face side of the casing 91, and a back cover 93 removably assembled to the back of the casing 91. The casing 91 is made of stainless steel, brass, titanium, or other metal. The casing 91 therefore forms the metal case member (watch case) 9 in this embodiment of the invention. The antenna 21 and other components are assembled inside this case member 9.

More specifically, a circuit board 80 on which are mounted the receiver IC 81, CPU 82, and reference oscillator 311 implementing the receiving circuit 23, drive control circuit 3, and counter 6, the movement including gear trains and the motor constituting the driver 4, the high capacity secondary battery 72 (secondary cell) of the power supply 7, and the dial 95 and main plate 96 disposed on the face side of the movement, are assembled inside the case member 9.

The antenna 21 is fixed to the main plate 96 using a thermoplastic resin (hot melt resin) or UV-cure epoxy, for example. The antenna 21 could alternatively be fixed using a resilient sealant to provide shock absorbency.

The antenna 21 and receiver IC 81 are connected by two leads. More specifically, the antenna 21 and receiver IC 81 are electrically connected by soldering the end of the coil 212 from the antenna end to the circuit board 80. The electrical connection could also be made by mounting the antenna 21 on a polyimide flexible substrate, for example, and then fastening this substrate to the circuit board 80 with a screw.

The dial 95 can be made of brass (bronze, Bs), nickel silver, or other metal, but is preferably a material that passes the longwave standard time signal easily, such as plastic, ceramic, or other non-conductive material (electrical insulator).

Lugs 94 for attaching a wristband to the watch are rendered at two opposite portions of the casing 91, typically at the 12:00 and 6:00 parts of the dial 95. The wristband attached to this casing 91 has numerous links joined mutually pivotably by pins (spring pins), and the end links in the watchband are likewise pivotably connected to the casing 91 with pins.

The antenna 21 is rendered following the round inside surface 91A of the casing 91, that is, the case member 9. More specifically, as shown in FIG. 4, the plane shape of the magnetic core 211 of the antenna 21 is a circular arc substantially concentric to the inside surface 91A, and the coil 212 wound to the magnetic core 211 is therefore likewise formed in a plane circular arc.

The angle of intersection θ1 of the line segments connecting the center O of the inside surface 91A to the end surfaces at both ends 212A of the coil 212 is at least 60 degrees or more and preferably approximately 115 degrees.

Furthermore, the antenna 21 is disposed around 12:00 (approximately 10:00 to 2:00 in the illustrated embodiment) relative to the center O of the case member 9. The high capacity secondary battery 72 (secondary cell) is located at about the 7:00 position relative to the center O. The antenna 21 and high capacity secondary battery 72 are thus located on opposite sides of the center O, and are thus rendered at physically separated positions. The reference oscillator 311 is also disposed farther than the receiver IC 81 and CPU 82 from the antenna 21. A round plastic spacer not shown is also provided between the antenna 21 and movement as a buffer.

Because the core 211 is a plane arc, the angle of intersection is substantially 0 degrees between the axial direction of the end portions 211A of the core 211, that is, line L2 following the center line widthwise to the end portions 211A, and the tangent L1 to the inside surface 91A at the point adjacent to the end portions 211A of the core 211.

More particularly, if point P is the widthwise center of the core 211 at the ends 211B of the end portions 211A of the core 211, and point Q is where the radius passing through point P intersects the inside surface 91A, tangent L1 is the tangent to point Q. In addition, if ends 211B are the ends of the core 211 along the axis of the end portions 211A, that is, in the direction in which the end portions 211A extend the core 211, and are substantially parallel to the radius of the arc, line L2 is the line perpendicular to end surfaces 211B. Furthermore, this tangent L1 and line L2 are parallel. In other words, the angle of intersection between tangent L1 and line L2 is preferably substantially 0 degrees, but can be in the range 0 to 30 degrees.

Likewise, because the coil 212 is a plane circular arc, the line following the coil axis through both ends 212A of the coil 212 is substantially parallel to the tangent to the inside surface 91A at the point adjacent to the ends 212A of the coil 212.

When the antenna 21 receives the longwave standard time signal, part of the field component of the radio signal passes from one end portion 211A to the other end portion 211A of the antenna core 211. An ac current is thus inducted by the coil 212 wound to the core 211, and an ac voltage is thus generated at both ends of the coil 212. This ac voltage then flows to the receiving circuit 23 as an analog reception signal.

The receiving circuit 23 then amplifies, demodulates, and decodes this analog reception signal to acquire digital time data, which is then stored to the time data storage circuit 24.

The antenna 21 thus has directivity that reacts to the field around an extended line (i.e., the axis of the core 211 and coil 212) connecting the end portions 211A of the core 211. If the metal casing 91 is in proximity to the axial direction of the core 211 and coil 212, the casing 91 will therefore interfere with the field linking the coil 212, and the antenna characteristics (reception sensitivity) will drop.

The present invention solves this problem by rendering the core 211 and coil 212 in a plane circular arc shape such that the end portions 211A and ends 212A thereof conform to the inside surface 91A of the casing 91. As a result, the distance W1 to the casing 91 rendered in this axial direction is relatively great as shown in FIG. 4, and the signal reception sensitivity of the antenna 21 can be improved.

This distance W1 is determined in part by the diameter of this inside surface 91A. For example, if the diameter of the inside surface 91A is approximately 30 mm, the width of the antenna core is approximately 3 mm, and the angle of intersection between tangent L1 and line L2 is 0 degrees, the distance W1 from the widthwise center point P of the ends 211B of the core 211 (where point P is about 1.5 mm from the inside surface 91A) to the inside surface 91A is approximately 6.5 mm.

The distance between end portions 211A of core 211 and the battery 72 and reference oscillator 311 is greater than distance W1 so that, similarly to the casing 91, the battery 72 and reference oscillator 311 also do not interfere with the linkage field. On the other hand, because the reference oscillator 311 uses a 32.768 kHz quartz oscillator and this oscillation frequency is near the longwave reception frequency (40 kHz), signals could be picked up by the antenna 21 as noise if the reference oscillator 311 is close to the antenna 21. To prevent this, the battery 72 and reference oscillator 311 are separated from the core 211 by at least the same distance as from the core 211 to the casing 91.

The construction of the drive circuits 41, 42 of the motors 411, 412 is described next. Note that because the drive circuits 41, 42 are basically constructed identically, the second drive circuit 41 for the second motor 411 is described by way of example below.

Figure 7:
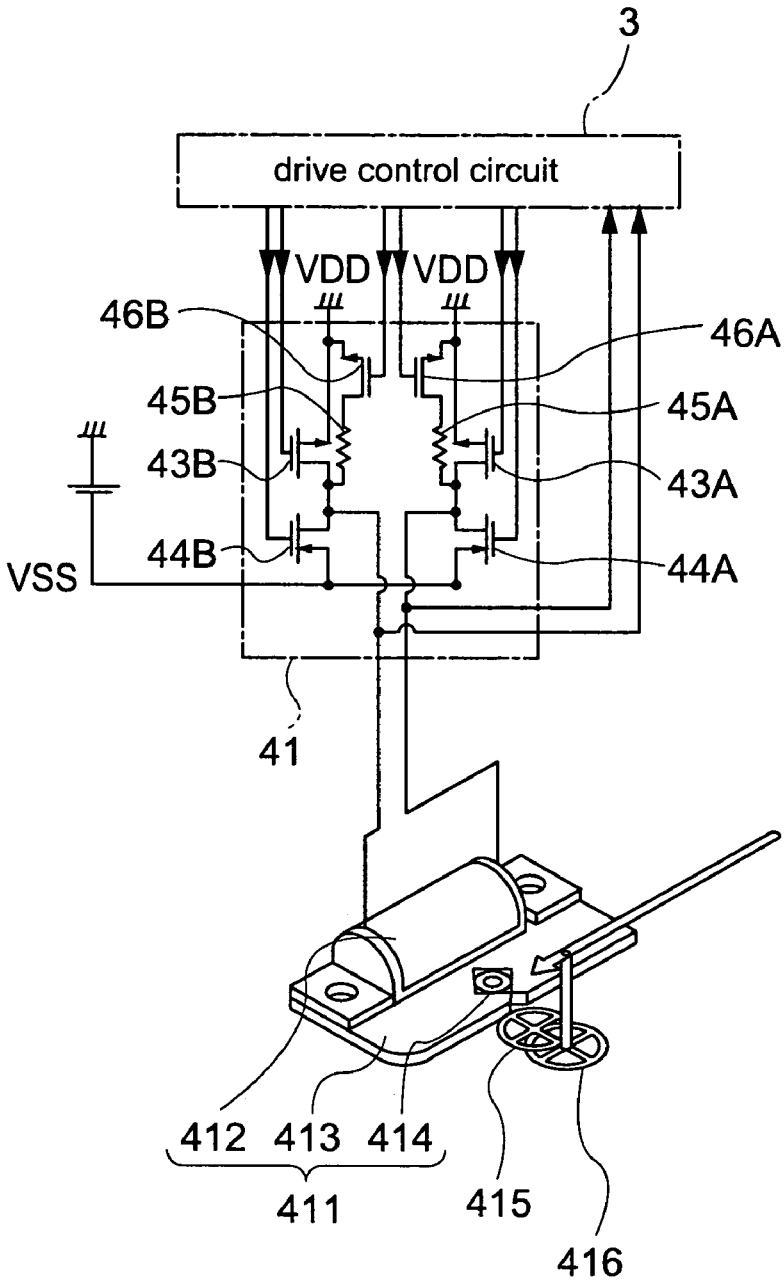
FIG. 7 is a circuit diagram of the motor drive circuit.

The motor 411 is a stepping motor driven by a pulse signal. More specifically, as shown in FIG. 7, the motor 411 includes a drive coil for producing magnetic flux according to a drive pulse supplied from the second drive circuit 41, a stator 413 excited by the drive coil 412, and a rotor 414 that turns inside the stator 413 as a result of the excited field.

Rotation of the rotor 414 of second motor 411 is transferred to the second hand through the gear train of fifth wheel 415 and fourth wheel 416 engaged with the rotor 414 through a pinion. Rotation of the rotor of the hour/minute motor 421 not shown is transferred to the minute hand and hour hand through the gear train including the third wheel, second wheel, day wheel, and center wheel.

The second drive circuit 41 includes a bridge circuit having a p-channel MOS transistor 43A and n-channel MOS transistor 44A serially connected, and a p-channel MOS transistor 43B and n-channel MOS transistor 44B serially connected.

The second drive circuit 41 also includes rotation detection resistors 45A, 45B parallel connected to the p-channel MOS transistors 43A, 43B, and p-channel MOS transistors 46A, 46B for supplying a chopper pulse for sampling to the rotation detection resistors 45A, 45B. By applying control pulses of the specific polarity and pulse width at appropriate timing from the drive control circuit 3 to the gate electrodes of MOS transistors 43A, 43B, 44A, 44B, 46A, 46B, drive pulses of different polarity can be supplied to the drive coil 412, and detection pulses can be supplied for exciting an induction voltage for field detection or detecting rotation of the rotor 414.

Operation of a radio-controlled watch 1 thus comprised is described below.

Displaying the time during normal operation is described first. The drive control circuit 3 normally uses the pulse signal (reference signal) input from the pulse synthesis circuit 31 to send a 1-Hz pulse signal and increment the count of the seconds time counter 612. When the seconds time counter 612 counts up such that the count differs from that of the seconds position counter 611, the coincidence detector 613 detects the mismatch and outputs a mismatch signal to the drive control circuit 3. Based on this mismatch signal, the drive control circuit 3 then outputs the seconds drive pulse signal PS1. Output of this seconds drive pulse signal PS1 causes the seconds position counter 611 to count up and the MOS transistors 43A, 3B, 44A, 44B of the second drive circuit 41 to switch on/off appropriately so that the second motor 411 is driven and the second hand moves. This operation continues until the coincidence detector 613 detects that the seconds position counter 611 and seconds time counter 612 again match. During normal operation, the seconds drive pulse signal PS1 is thus output once each time the seconds time counter 612 counts up one second based on the 1-Hz signal input thereto, and the second hand moves one step every one second.

The hour and minute are kept similarly. That is, the hour/minute drive pulse signal PS2 is output from the drive control circuit 3, and a pulse signal is output from the hour/minute drive circuit 42 to the hour/minute motor 421 based on this hour/minute drive pulse signal PS2 to move the minute hand and hour hand so that the count held by the hour/minute position counter 621 matches the count of the hour/minute time counter 622.

Operation when receiving a time signal is described next.

When the set start-receiving time is reached, the drive control circuit 3 outputs a specified pulse signal to the second drive circuit 41 and hour/minute drive circuit 42, turns MOS transistors 43A, 43B on, thus connecting and shorting both ends of the drive coil 412 to VDD. Note that VDD (high voltage side) is the reference potential (GND), and VSS (low voltage side) is the supply voltage in this embodiment.

After shorting the drive coil 412 of the motors 411, 412 and stopping the motors 411, 412, the drive control circuit 3 drives the receiving circuit 23 to start receiving the time signal. It should be noted that time signal reception can be forced to start by operating the external input device 8, but even when reception is started by the external input device 8, the drive control circuit 3 first shorts the drive coil 412 to a specified potential (such as VDD), and then drives the receiving circuit 23 to start time signal reception.

When the receiving circuit 23 operates, the radio signal (time signal) received through the antenna 21 is processed by the receiving circuit 23 and then stored to the time data storage circuit 24. The receiving circuit 23 also verifies if the received time information is correct. More specifically, the standard time signal takes one minute to transmit the time data, and determines if the time data was correctly received by determining if the time data received in plural sequential time signals is at one-minute intervals.

If the received time data is correct, the time data is output to the seconds time counter 612 and hour/minute time counter 622, and the counts of the seconds time counter 612 and hour/minute time counter 622 are adjusted to the correct values as directed by the drive control circuit 3. Shorting the drive coil 412 also ends, and the motors 411, 412 resume operation.

If the time counters 612, 622 disagree after the counts of the seconds time counter 612 and hour/minute time counter 622 are corrected, mismatch signals are output from the corresponding coincidence detectors 613, 623 until the counts match again, and the drive control circuit 3 thus outputs the drive pulse signals PS1, PS2 to move the hands. The hands are thus advanced rapidly until the counters match, the positions of the hands are thus automatically adjusted to the received time data, and the watch is reset to the correct time.

The benefits of the present invention according to this preferred embodiment are described below.

(1) Because both end portions 211A of the core 211 of the antenna 21 are disposed along the inside surface 91A of the case member 9, a relatively great distance W1 can be assured from the ends 211B of the core 211 to the inside surfaces 91A in the axial direction of the core 211, that is, the distance from ends 211B of the core 211 to the inside surfaces 91A opposite the ends 211B in line with the axis of the core. As a result, interference by the case member 9 with the field of the standard time signal linking to the coil 212 through the core 211 is reduced, and a drop in antenna characteristics when using a metal case member 9 can be suppressed.

External wireless information can therefore be received even using a metal case member 9, a high quality appearance and design compared with using a plastic case can be achieved, and a radio-controlled watch 1 with minimal design limitations can be provided.

The manufacturing cost of a timepiece with a metal case can also be reduced because it is not necessary to provide a notch in the case member 9, nor is it necessary to use a double case having a metal case member and a plastic inside case.

A radio-controlled watch 1 according to this embodiment of the invention can also be made smaller while assuring sufficient antenna 21 length and preventing a drop in antenna characteristics because the antenna 21 can be disposed in proximity to the inside surface 91A.

(2) The coil 212 is wound to the end portions 211A of the core 211, and the ends 212A of the coil 212 can therefore also be disposed along the inside surface 91A of the case 9. Interference by the case member 9 with the field of the standard time signal linking to the coil 212 from the end portions of the coil 212 is therefore reduced, and any drop in antenna characteristics when using a metal case member 9 can be further suppressed. The coil 212 can also be wound more times than compared with winding the coil 212 only to the middle portion of he core 211, and antenna 21 sensitivity can therefore be improved.

(3) By locating the antenna 21 at a position separated from the high capacity secondary battery 72 (secondary battery), a battery 72 with a metal case has less effect on antenna characteristics, and any drop in antenna characteristics can be further suppressed.

Signals from the reference oscillator 311 can also be prevented from being picked up as noise in the received signal, and any drop in antenna characteristics can thus be further suppressed, because the antenna 21 is separated from the reference oscillator 311.

(4) The entire length of the antenna 21 can be disposed along the inside surface 91A of the case because the antenna 21 is a plane circular arc. The antenna 21 can therefore be located with a very small gap between the antenna 21 and inside surface 91A, thereby eliminating dead space inside the case 9. Space inside the case 9 can therefore be used efficiently. The case member 9 can therefore be made smaller, and the antenna 21 can be rendered inside a ladies' wristwatch, which is typically smaller than a men's wristwatch.

This rendering of the antenna 21 inside the case member 9 also reduces limitations on the layout of batteries, ICs, and other components inside the case member 9. A relatively large antenna 21 with more coil windings can also be used, thereby improving antenna sensitivity.

(5) By assuring that the central angle of the antenna 21 coil 212 is 60 degrees or greater, the length of the coil 212 (antenna length) is 15 mm or greater, and standard time signals can therefore be received. Furthermore, by setting this central angle to approximately 115 degrees or more as in the foregoing embodiment, antenna length can be increased accordingly and antenna characteristics thus improved.

(6) If the case member 9 is plastic or other non-metallic material, measures such as using thick walls or providing reinforcing ribs must be used during case 9 manufacture in order to assure sufficient strength. By using a metal case 9, however, a timepiece according to the present invention affords a stronger case 9 if the wall thickness is the same as that of a plastic case, and makes it, possible to reduce the wall thickness of the case 9 needed to assure the same strength.

(7) By laminating multiple amorphous foil layers through the thickness of the radio-controlled watch 1, that is, in the direction connecting the back cover 93 and crystal 92, to form the antenna 21, the present invention affords an antenna 21 that is much thinner than a ferrite core antenna. The thickness of the radio-controlled watch 1 can therefore be reduced, and a watch 1 with a thin, high quality appearance can be provided.

(8) Because the drive control circuit 3 holds the drive coil 412 to VDD during signal reception, antenna characteristics are not adversely affected as they are when the drive coil 412 is open, and antenna characteristics can therefore be improved.

(9) By inserting a magnetic core 211, the antenna 21 has sharper directivity and improved antenna characteristics.

(10) At approximately 0.32 A/m, the coercive force of the amorphous material is lower than that of ferrite, and is therefore less susceptible to the magnetic influence of any nearby metal. By using an amorphous foil material as the magnetic core 211 in this embodiment of the invention, the magnetic core 211 is resistant to magnetic influences from the case member 9 even when the case member 9 is metal. The magnetic core 211 and, therefore, the antenna 21, can thus be rendered closer to the inside surface 91A of the case member 9, and dead space between the inside surface 91A and antenna 21 can be reduced. Space inside the case member 9 can therefore be used efficiently and without waste, and a smaller case member 9 can therefore be used.

Furthermore, when a metal case member 9 is used in a radio-controlled watch, an insulating spacer is generally disposed between the inside surface 91A of the case member 9 and the antenna 21 in order to isolate the antenna 21 from the case member 9. By making the magnetic core 211 from an amorphous material that is resistant to magnetic influences from the metal case member 9 and can thus be rendered more closely to the inside surface 91A, this embodiment of the present invention can use a thinner spacer. As a result, a smaller case member 9 can be used even if an internal spacer is also provided.

Second Embodiment

A second embodiment of the present invention is described next. This embodiment differs from the foregoing embodiment only in the plane shape of the antenna, and only the shape of the antenna is therefore described below. Note that identical or like parts in this and the preceding embodiment are described with like reference numerals, and further description thereof is omitted or simplified below.

Figure 8:
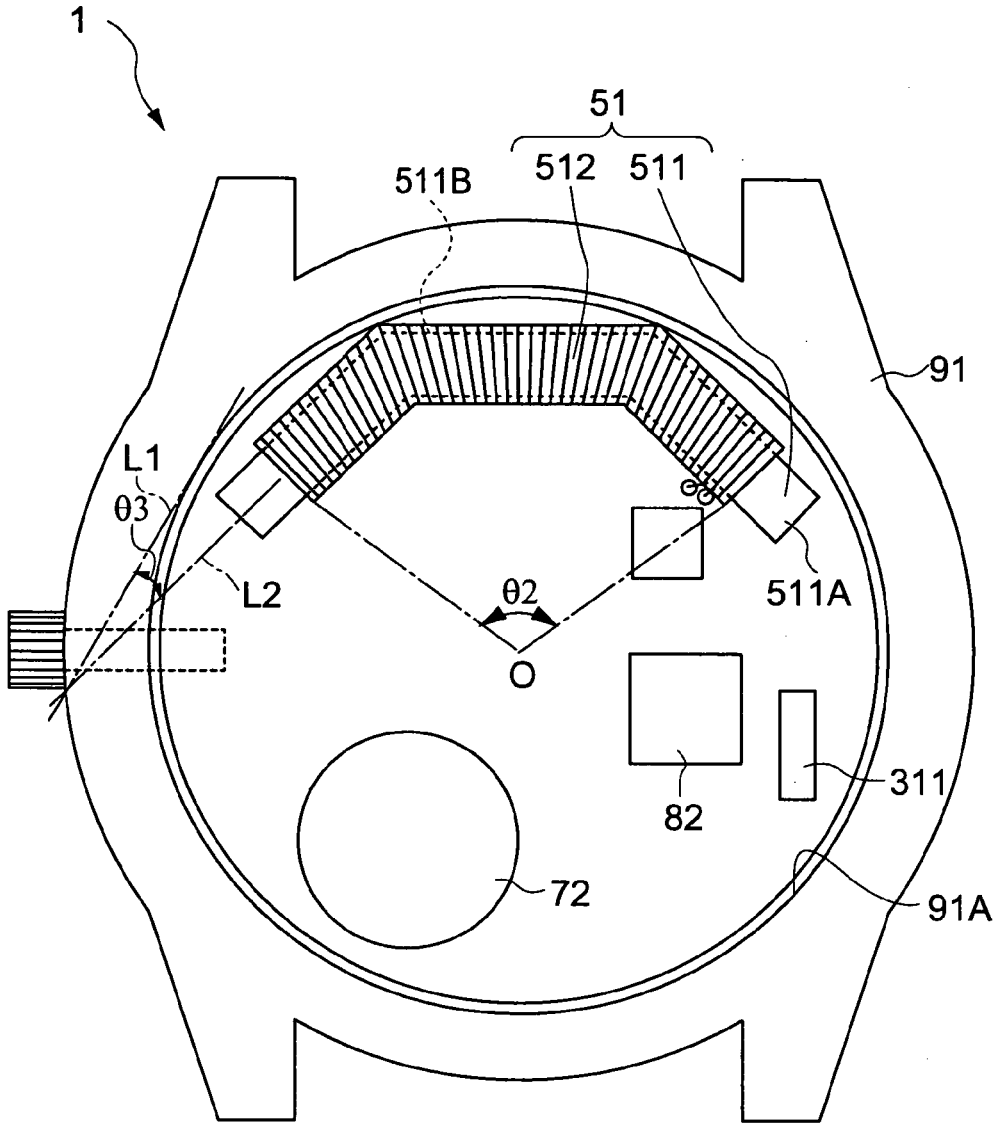
FIG. 8 is a schematic plan view of a timepiece according to another preferred embodiment of the invention.

As shown in FIG. 8 the magnetic core 511 of an antenna 51 according to this second embodiment of the invention has end portions 511A and a middle portion 511B connecting the end portions 511A. The end portions 511A and middle portion 511B are not plane circular arc members, but instead are straight.

The angle of intersection θ2 of the line segments connecting center point O of the inside surface 91A and both ends of the coil 512 is 60 degrees or more and is preferably approximately 115 degrees as in the first embodiment. Furthermore, line L2 along the axis of the end portions 511A of the magnetic core 511, and the tangent L1 to the inside surface 91A adjacent to the end portions 511A, intersect at an angle θ3 of approximately 15 degrees, that is, in a range of 0 to 30 degrees, with the end portions of the coil 512 disposed along the inside surface 91A.

This second embodiment of the invention affords the same benefits as the first embodiment described above.

In addition, (11) because the antenna 51 has a polygonal shape rather than a smooth curved shape, cutting the magnetic core 511 from an amorphous sheet material, and winding the coil 512 to the core, are easier compared with using a circular arc-shaped core 211. Antenna 51 manufacturability, and thus productivity, are therefore improved.

It should be noted that the present invention is not limited to the foregoing embodiments.

More specifically, specific implementations of the present invention are described herein with reference to the accompanying figures, but various modifications in the shape, material, quantity, and other detailed aspects of these embodiment will be apparent to one with ordinary skill in the related art without departing from the technical concept of the invention and the scope of the accompanying claims.

Figure 9:
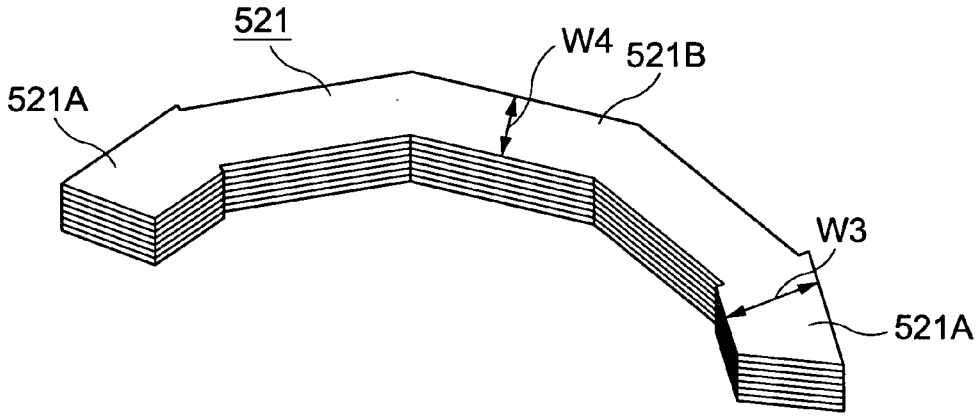
FIG. 9 are oblique views showing a variation of an antenna according to the present invention, (A) showing the core and (B) showing the antenna including the core and coil.
Figure 9:
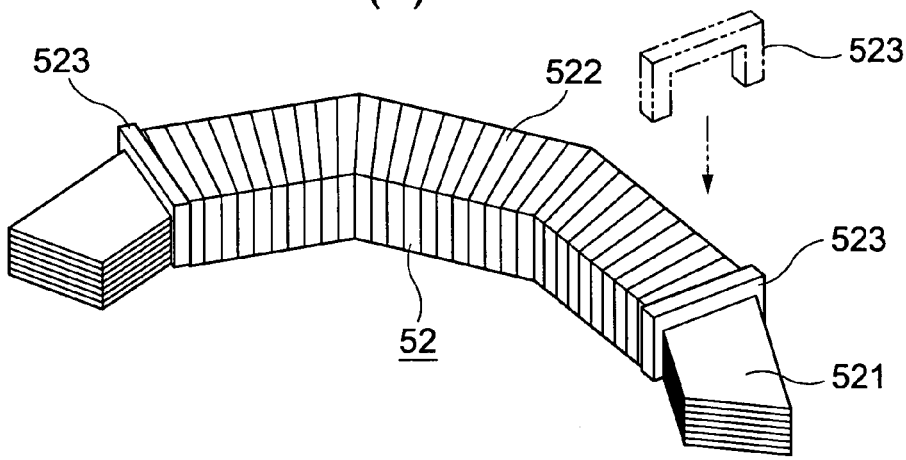

As shown in FIG. 9(A) and (B), for example, the antenna 52 could have a flat polygonal configuration in which there are multiple middle portions 521B between the end portions 521A of the core 521, and the coil 522 is then wound to this core 521. The core 521 could have the same width throughout, or preferably, as shown in FIG. 9, the width W3 of the end portions 521A where the coil 522 is not wound is wider than the width W4 of the middle portions 521*b* where the coil 522 is wound. By thus rendering the end portions 521A with a greater width, the volume of the core 521 can be increased without changing the thickness of the part where the coil 522 is wound, and antenna characteristics can therefore be improved without increasing the size of the antenna 52.

As with an antenna 51 according to the foregoing second embodiment, this antenna 52 also makes cutting the core and winding the coil simple. Furthermore, because the antenna is closer to a circular arc than is the antenna 51 of the second embodiment, there is less dead space between the antenna 52 and the inside surface 91A of the case than there is with the above antenna 51, and space efficiency is thus improved.

Insulation tape approximately 20 to 30 μm thick is preferably wound to the core 521 where the coil 522 is wound with this antenna. Wrapping the core with insulation tape reliably isolates the coil 522 and core 521, and prevents the coil 522 from being cut at the corner edges of the core 521 when the core 521 is rectangular in section as shown in FIG. 9.

Furthermore, by setting a basically U-shaped clip 523 of polyester, for example, at the shoulder of the core 521, that is, at the ends of the coil 522, the coil 522 can be easily wound and the ends of the coil can be prevented from unraveling.

An antenna of which the middle portion of the core is a circular arc and the end portions are straight could also be used.

Figure 10:
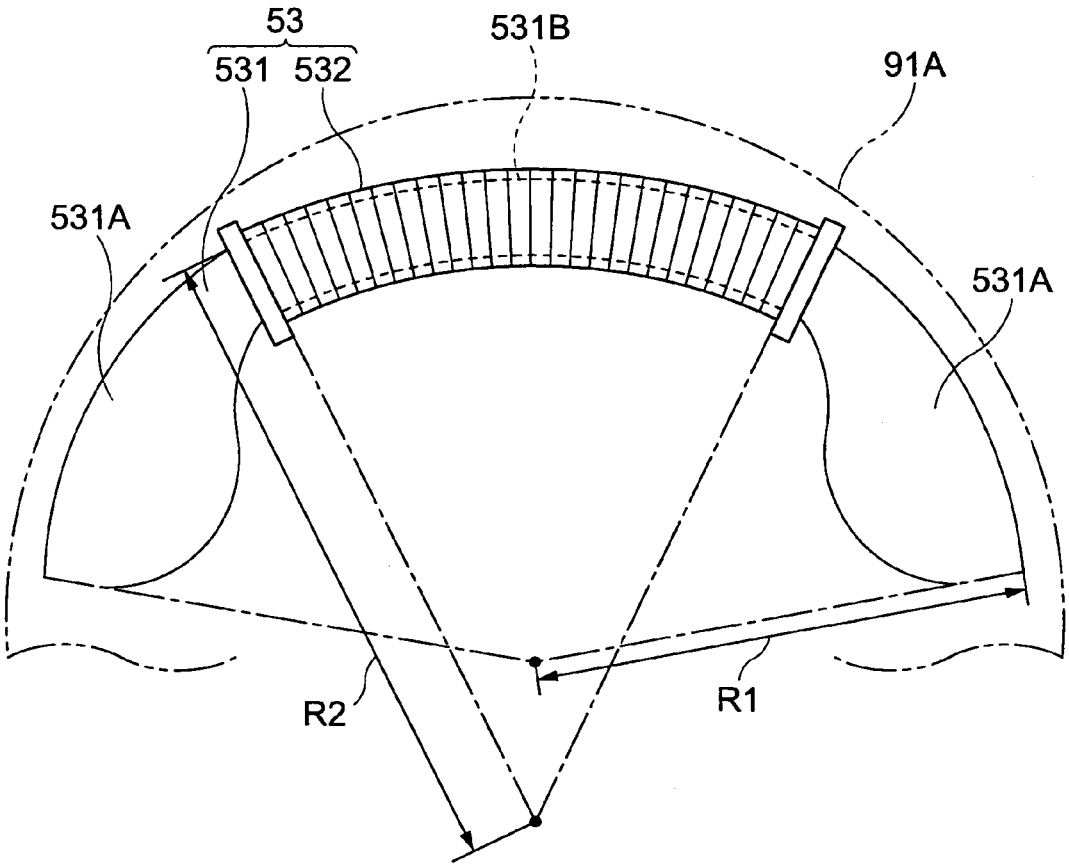
FIG. 10 is a schematic plan view of a timepiece according to another preferred embodiment of the invention.

The antenna could also be configured as shown in FIG. 10. The core 531 of this antenna 53 is a plane circular arc, but the curvature at the end portions 531A differs from the curvature of the middle portion 531B. More specifically, if the radius of curvature of the contour of the outside side of the end portions 531A is R1, and the radius of curvature of the outside side of the middle portion 531B is R2, R1<R2. The curvature of the middle portion 531B is therefore less than the curvature of the end portions 531A, and the middle portion 531B is nearly straight. Because the middle portion 531B is nearly straight with this antenna 53, it is easier to wind the coil 532, winding efficiency can be improved, and the antenna 53 can be easily manufactured.

Furthermore, if the radius of curvature of the inside surface 91A at the inside circumference of the case member 9 is nearly equal to R1, the end portions 531A of the core 531 can be disposed to conform to the curvature of the inside surface 91A.

The middle portion 531B of the core 531 could also made straight in this antenna 53.

As also shown in FIG. 10, the end portions 531A of the core 531 are large in both width and length, thereby increasing the area. The antenna 53 can therefore efficiently and easily pick up radio signals through these large end portions 531A, and the reception sensitivity of the antenna 53 can be improved.

The length of these end portions 531A is desirably ⅙ to 1/12 the circumference of the inside surface 91A of the case member 9, or ½ to 1 times the length of the middle portion 531B.

In the first embodiment of the invention described above, the magnetic core 211 has a plane circular-arc shape, and the center of curvature of the contour on the outside surface is the same (that is, center O in FIG. 4) as the center of curvature of the contour on the inside surface of the circular arc in the middle portion where the coil 212 is wound.

Figure 11:
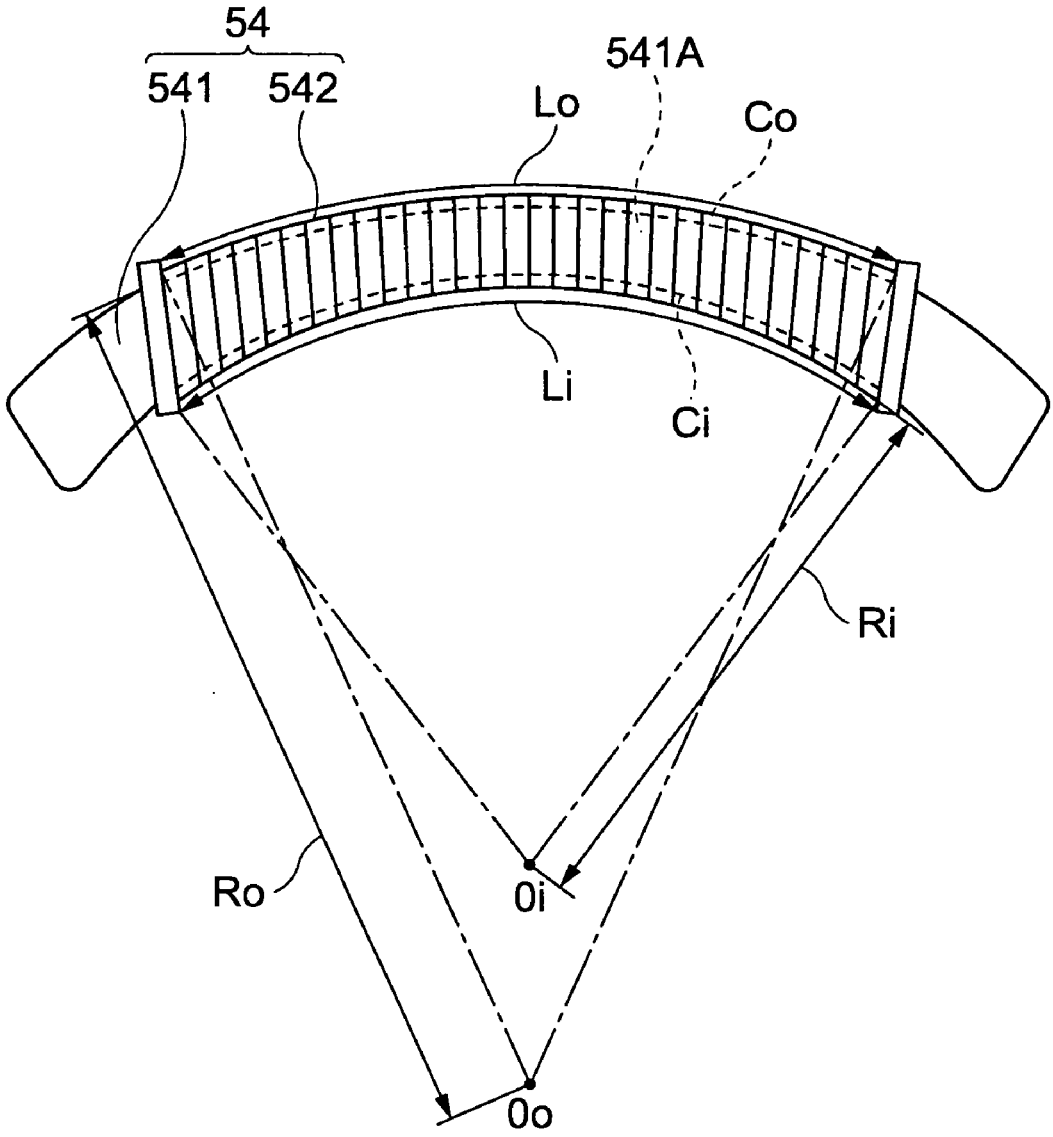
FIG. 11 is a schematic plan view of a timepiece according to another preferred embodiment of the invention.

As shown in FIG. 11, however, antenna 54 could be configured so that the center of curvature Oo of the outside contour Co (the top edge as seen in FIG. 11) of the plane shape in the middle portion 541A of the core 541 is different from the center of curvature Oi of the inside contour Ci (the bottom edge as seen in FIG. 11). In the implementation shown in FIG. 11, the outside contour Co is an arc with a radius of curvature Ro, and the inside contour Ci is an arc with a radius of curvature Ri, and centers of curvature Oo and Oi are the center points of these different arcs. In addition, Oo and Oi are different points with Oo farther from the middle portion 541A than Oi. As a result, the curvature of the outside contour Co is smaller than the curvature of the outside contour of a core 211 of the same size as core 541, and the outside contour Co is nearly straight.

When winding the coil 212 to a core 211 as shown in FIG. 4, the length along the outside contour of the core 211 where the coil 212 is wound is greater than the length of the inside contour of the core 211 where the coil 212 is wound, and this tends to produce a gap between adjacent coil 212 wires along the outside contour. More specifically, while the coil 212 wire can be wound with no gaps between adjacent winds along the inside contour in the middle portion of the core 211, gaps appear between adjacent winds of the coil 212 along the outside contour, and winding efficiency thus decreases.

With an antenna as shown in FIG. 11 in which the outside contour Co of this middle portion is closer to a straight line than it is in the antenna shown in FIG. 4, the coil 542 wire can be more easily wound with no gaps between adjacent conductors at the outside contour Co, and the length Lo of the outside contour Co where the coil 542 is wound, and the length Li of the inside contour Ci where the coil 542 is wound, can be made substantially equal. Gaps between the conductors of the coil 542 can therefore be significantly reduced or eliminated along the outside contour Co when the coil 542 wire is wound with no gaps between winds along the inside contour Ci, and winding efficiency can be improved. Antenna performance can therefore be improved while minimizing overall antenna 54 length.

Figure 12:
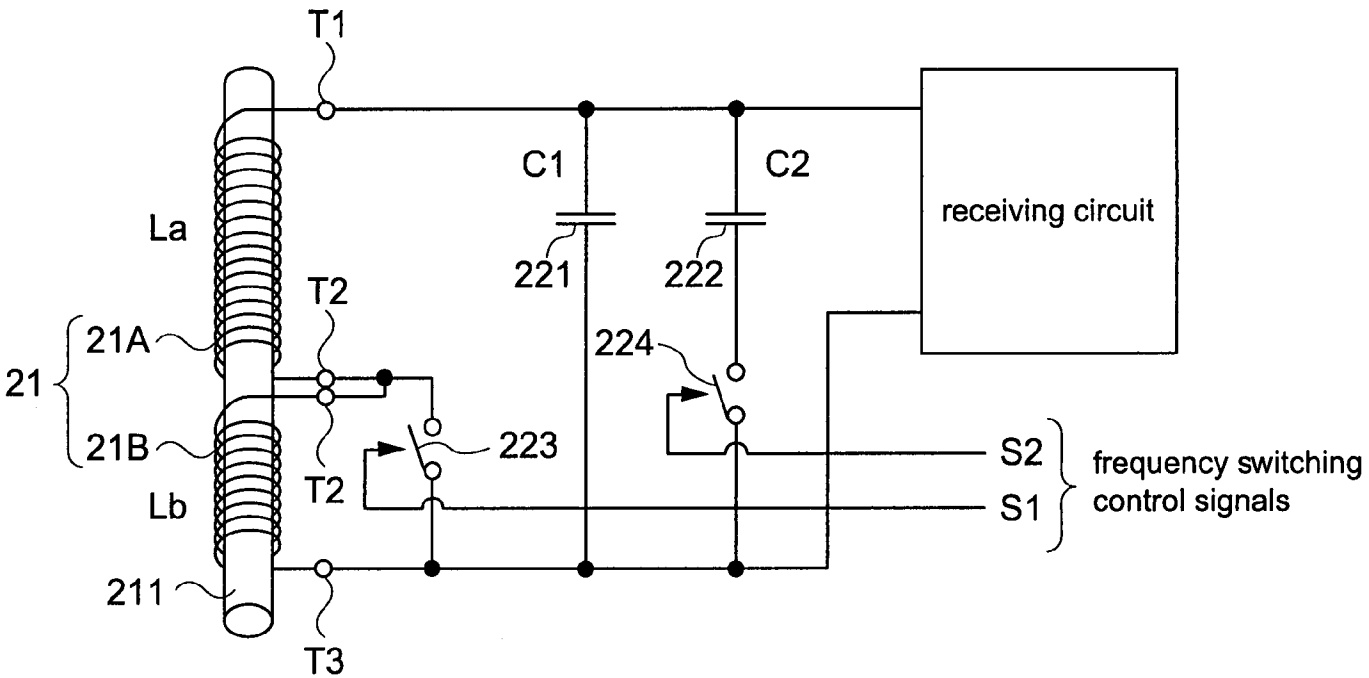
FIG. 12 is a block diagram showing a variation of the tuning circuit and antenna according to the present invention.

In the embodiment shown in FIG. 3 the reception signal frequency is switched by using switch 22C to change the electrostatic capacitance of the circuit (the "antenna circuit" below) including the antenna 21 and tuning circuit 22. As shown in FIG. 12, however, the reception signal frequency can also be changed by changing both the electrostatic capacitance and inductance (antenna inductance) rather than changing only the electrostatic capacitance of the antenna circuit.

In FIG. 12 the antenna 21 includes a first antenna portion 21A with inductance La, and a second antenna portion 21B with inductance Lb, and switching switch 223 changes the total inductance of the antenna circuit.

Switch 223 switches the antenna circuit based on the frequency switching control signal S1 output from the drive control circuit 3. When the switch 223 is on, the inductance of the antenna circuit is La, and when the switch 223 is off, the inductance is La+Lb.

Two capacitors 221 (electrostatic capacitance C1) and 222 (electrostatic capacitance C2) are parallel connected to the antenna 21, and switching another switch 224 changes the total electrostatic capacitance of the antenna circuit.

This switch 224 switches the circuit based on frequency switching control signal S2 output from the drive control circuit 3. When the switch 224 is on, the electrostatic capacitance of the antenna circuit is C1+C2, and when the switch 224 is off, the electrostatic capacitance is C1.

Terminals T1, T2, and T3 are also shown in FIG. 12.

By thus changing the inductance and electrostatic capacitance of the antenna circuit using switches 223, 224, the inductance of the antenna circuit can be changed and the frequency of the signal received by the antenna 21 can be switched. This makes it possible to switch the antenna circuit to receive standard time signals at three different frequencies, including the 40-kHz standard time signal output in Japan from the station at Mt. Otakadoya in eastern Japan, the 60-kHz signal output from the station at Mt. Hagane in western Japan or the 60-kHz signal broadcast in the United States, and the 77.75-kHz standard time signal broadcast in Germany.

More specifically, standard time signal reception can be switched by appropriately turning switches 223, 224 on or off to receive the desired signal as shown in FIG. 13.

When switch 223 is off and switch 224 is on, the antenna 21 receives the 40-kHz standard time signal, and the tuning frequency (resonance frequency) $f_{40k}$(=40 kHz) of the antenna circuit is shown by equation 1 below.

$$f_{40k} = \frac{1}{2\pi\sqrt{(L1 + L2)\cdot(C1 + C2)}}$$

When switch 223 and switch 224 are both on, the 60-kHz standard time signal is received by the antenna 21. The tuning frequency (resonance frequency) $f_{60k}$(=60 kHz) of the antenna circuit is shown by equation 2 below.

$$f_{60k} = \frac{1}{2\pi\sqrt{L1\cdot(C1 + C2)}}$$

When switch 223 is on and switch 224 is off, the 77.5-kHz standard time signal is received by the antenna 21. The tuning frequency (resonance frequency) $f_{77.5k}$(=77.5 kHz) of the antenna circuit is shown by equation 3 below.

$$f_{77.5k} = \frac{1}{2\pi\sqrt{L1\cdot C1}}$$

Note that La, Lb, C1, and C2 are predetermined so that the equations $f_{40k}$=40 kHz, $f_{60k}$=60 kHz, and $f_{77.5k}$=77.5 kHz are true.

This configuration also reduces the change in the impedance of the antenna circuit when the reception frequency changes, enables desirable impedance matching with the receiver IC, and improves antenna sensitivity.

This is further described with reference to FIG. 14.

Figure 14:
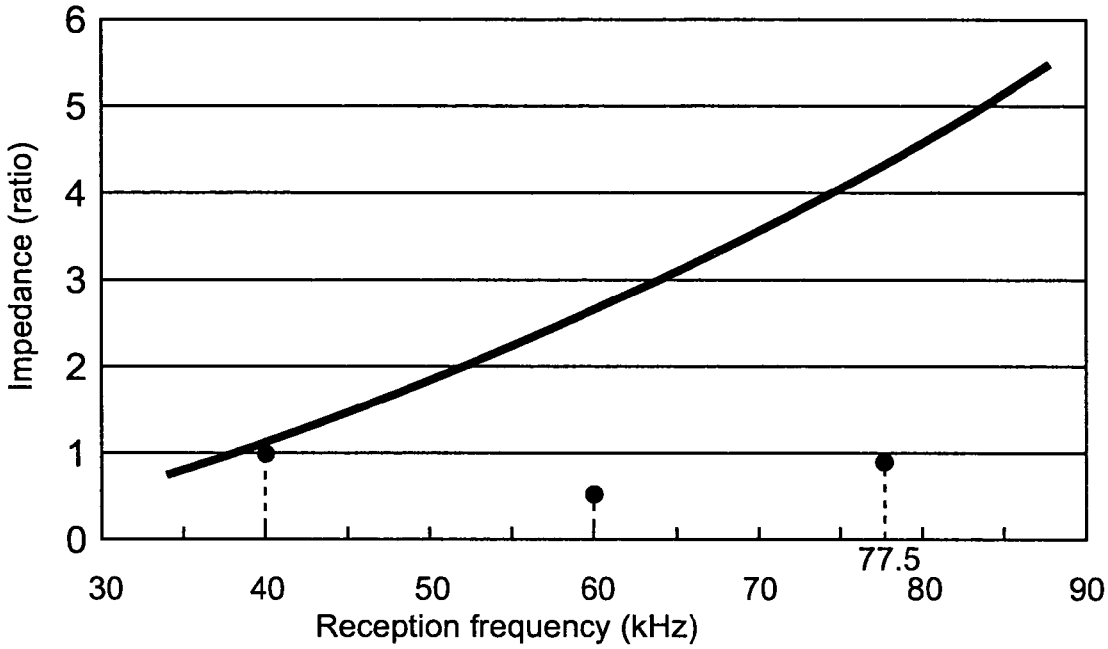
FIG. 14 is a graph showing the relationship between the reception frequency and the impedance of the antenna circuit.

FIG. 14 shows the reception frequency of the antenna circuit on the x-axis and the impedance of the antenna circuit on the y-axis. The values on the y-axis show impedance as a ratio where the impedance when tuned to the 40-kHz reception frequency is 1.

The curve in FIG. 14 shows the relationship between reception frequency and impedance in an antenna circuit in which the reception frequency is changed by changing only the electrostatic capacitance and antenna inductance remains constant. The impedance (ratio) when the reception frequency is 40 kHz is approximately 1, and the impedance (ratio) when tuned to 77.5 kHz is approximately 4. As a result, the impedance increases almost 4 times when tuned to 77.5 kHz. When the range of impedance change is this great, impedance matching the antenna circuit and receiver IC is difficult across the entire reception signal frequency range. More specifically, if the input impedance of the receiver IC is set to match the antenna circuit impedance when tuned to a reception frequency of 40 kHz, reception sensitivity is good when receiving 40-kHz signals. Because of the great change in antenna circuit impedance when receiving 60-kHz and 77.5-kHz signals, however, the impedance cannot be properly matched to the receiver IC, and the reception sensitivity of the antenna is therefore poor.

With an antenna circuit that changes the reception frequency by changing both inductance and electrostatic capacitance as shown in FIG. 12, however, the impedance ratio when tuned to 40 kHz, 60 kHz, and 77.5 kHz is as indicated by the three solid dots in FIG. 14. As will be known from these plotted points, the impedance of the antenna circuit remains substantially constant when the reception frequency is set to 40 kHz, 60 kHz, and 77.5 kHz with an antenna circuit constructed as shown in FIG. 12. Impedance matching with the receiver IC is therefore simple, and a radio-controlled timepiece with good reception sensitivity to all three standard time signal frequencies can be provided.

It should be noted that the frequencies of the signals received by the antenna 21 can be desirably set by appropriately setting La, Lb, C1, and C2 shown in FIG. 12.

It will also be obvious that a radio-controlled timepiece capable of receiving more frequencies can also be produced by dividing the antenna 21 into three or more antenna portions, or providing three or more capacitors to change the inductance and electrostatic capacitance of the antenna circuit appropriately.

The reception signal frequency could also be changed by changing only the inductance of the antenna circuit.

Figure 15:
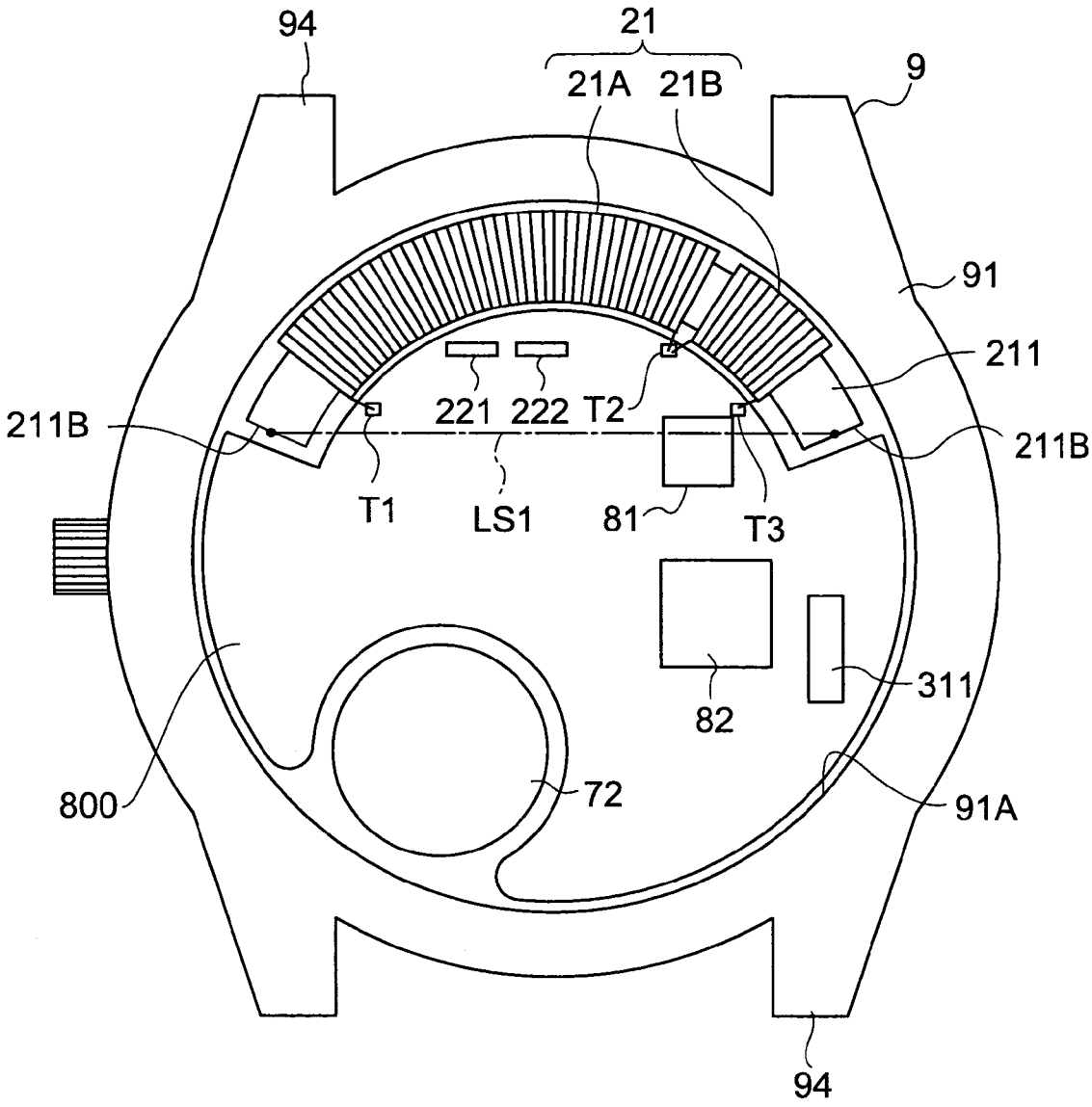
FIG. 15 is a schematic plan view of a watch having the antenna and tuning circuit unit shown in FIG. 12.
Figure 16:
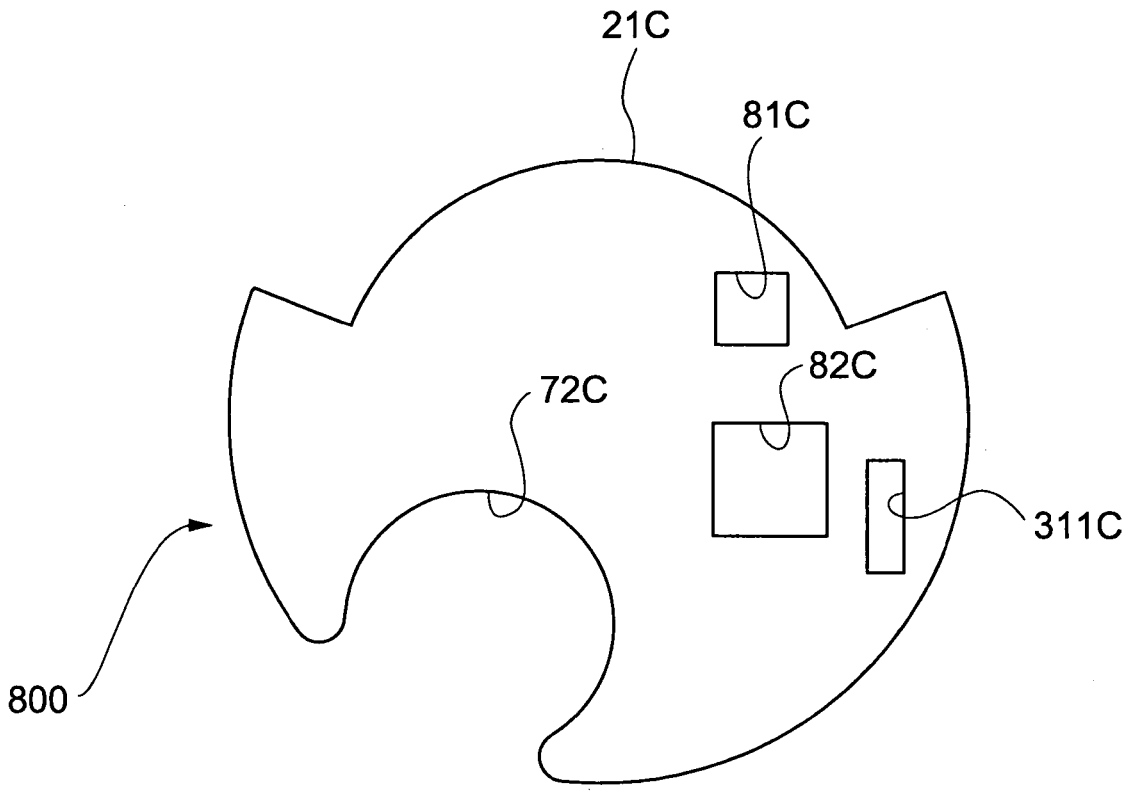
FIG. 16 is a schematic plan view of a circuit board in the present invention.

FIG. 15 shows a specific implementation of a radio-controlled watch including an antenna circuit as shown in FIG. 12. The antenna 21 conductor is, for example, polyurethane coated copper wire, and is soldered to the circuit board 800 at terminals T1, T2, T3. The conductor from both first antenna portion 21A and second antenna portion 21B is soldered to terminal T2. As shown in FIG. 16, this circuit board 800 also has cutouts 21C, 72C 81C, 311C of substantially the same shape as the antenna 21, high capacity secondary battery 72, receiver IC 81, CPU 82, and reference oscillator 311, respectively.

Terminals T1, T2, T3, and capacitors 221, 222 that are circuit elements of a receiver according to the present invention are rendered in the space enclosed by the core 211 and the line segment LS1 connecting the center points of both ends 211B of the antenna core 211, thereby efficiently using this space formed by rendering the antenna 21 as a plane circular arc. Furthermore, because this configuration shortens the conductors connecting the antenna 21 and the capacitors 221, 222, the chance of noise being picked up by these conductors is small, and the antenna 21 can provide more accurate signal reception. It will also be obvious that parts of the tuning circuit 22 or receiving circuit 23 other than these capacitors can be located in this space, including, for example, the receiver IC 81.

Conversely, components other than elements of the tuning circuit 22 or receiving circuit 23, such as the CPU 82 or reference oscillator 311, can adversely affect antenna characteristics if located near the antenna 21, and are therefore preferably not located in this space. If the CPU 82 is located in this space near the antenna 21, for example, noise from the core of the CPU 82 could interfere with signal reception by the antenna 21. The CPU 82 is therefore located outside of this space away from the antenna 21 as shown in FIG. 15, so that noise from the CPU 82 is not picked up by the antenna 21.

Figure 17:
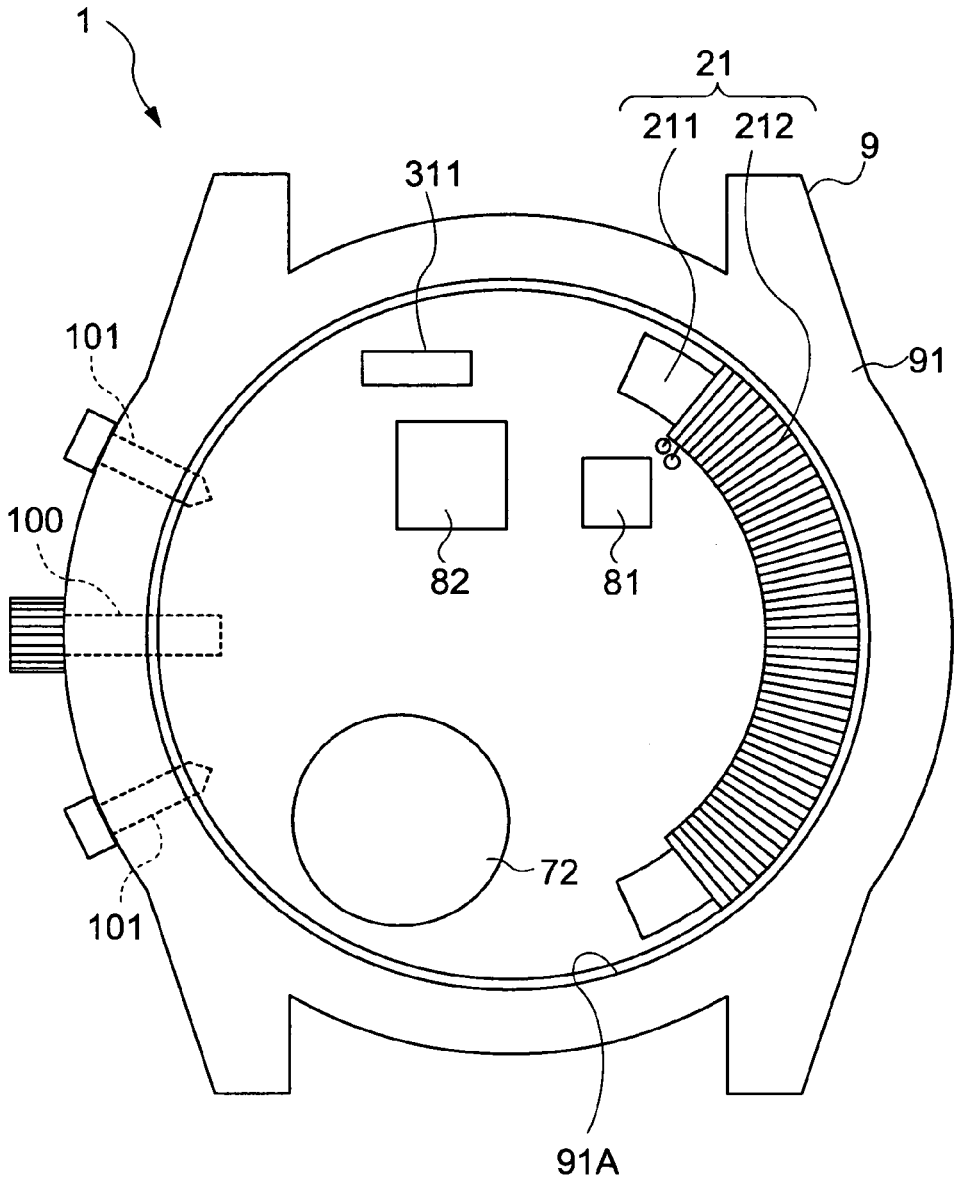
FIG. 17 is a schematic plan view of another implementation of the present invention.

The location of the antenna shall not be limited to the 12:00 position inside the case member 9 as described in the preceding embodiments, and as shown in FIG. 17 could be located at 9:00, 6:00, or 3:00. However, because the crown and stem 100, and other button stems 101, are typically located near the 3:00 position, the antenna is preferably located at 6:00, 9:00, or 12:00, for example, so as to not interfere with the crown and other button stems. However, if there are buttons located from 2:00 to 4:00, and the antenna 21 is located around 12:00 or 6:00, the length of the antenna 21 will be limited to avoid interference with the button stems 101. The antenna 21 is thus preferably located around 9:00.

Figure 18:
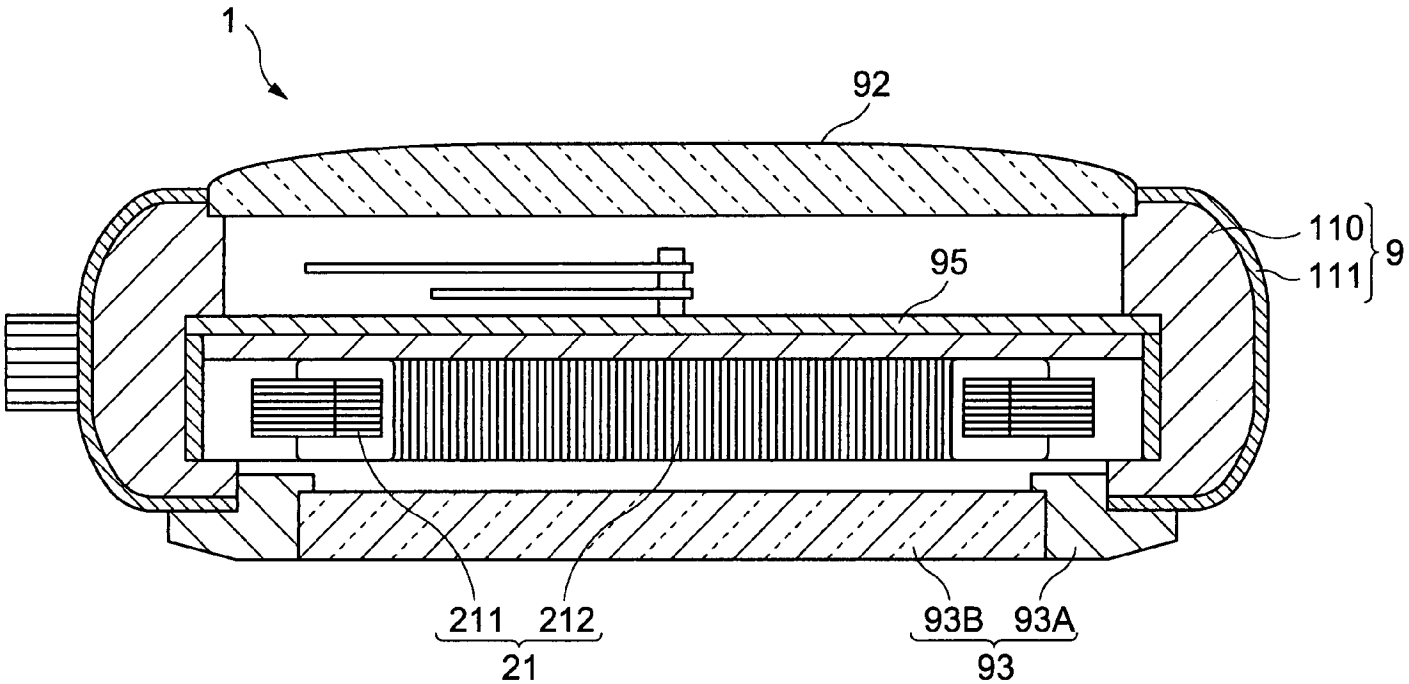
FIG. 18 is a schematic plan view of another implementation of the present invention.

The case member 9 of a radio-controlled watch 1 according to the present invention shall also not be limited to metal. More specifically, the watch could have a plastic case 110 with the surface coated with a stainless steel, titanium, or other metal plating 111 as shown in FIG. 18. The case member 9 could also be plastic, ceramic, or other non-conductive material, or these plastic or other materials could be surface coated to form an external metallic coating.

The back cover 93 is also not limited to metal, and as shown in FIG. 18 could have a glass plate 93B fit inside a metal ring 93A. If part of the back cover 93 is glass, radio waves can pass easily through the glass plate 93B into the case member 9, and reception sensitivity can therefore be improved. Reception sensitivity can also be improved if the dial 95 is also plastic because radio waves can also pass through the plastic dial 95 into the case member 9.

The antenna core shall also not be limited to layered amorphous foil, and a ferrite core or other magnetic material could be used.

Furthermore, the length of the antenna core can be desirably determined, and if formed in a circular arc, the central angle can be increased to approximately 180 degrees, or even greater than 180 degrees. Antenna characteristics also improve as the antenna length increases. Therefore, while a central angle of 50 to 60 degrees is sufficient to achieve a minimum antenna length of approximately 15 mm, the central angle is preferably greater in order to improve antenna characteristics.

However, if the central angle is greater than 180 degrees, the angle difference between the axial direction at both ends of the antenna 21, that is, the direction in which the link field (magnetic flux) enters and exits, and the direction of the magnetic flux in the middle portion of the antenna 21, will be 90 degrees or more, and the field component will not flow smoothly. The central angle is therefore preferably not greatly more than 180 degrees.

Therefore, when the length of the antenna core is formed in a circular arc or a polygon that is approximately a circular arc, the central angle is preferably in the range from approximately 50 degrees to approximately 240 degrees. Further preferably, the central angle is in the range from approximately 60 degrees to approximately 180 degrees considering the direction of flux linkage and antenna characteristics.

Note, further, that in practice the central angle will be determined with consideration for the space needed to locate the motor coil, battery, and other components.

When the core is not a circular arc, the relative positions of the ends are still determined assuming a circular arc configuration.

Figure 19:
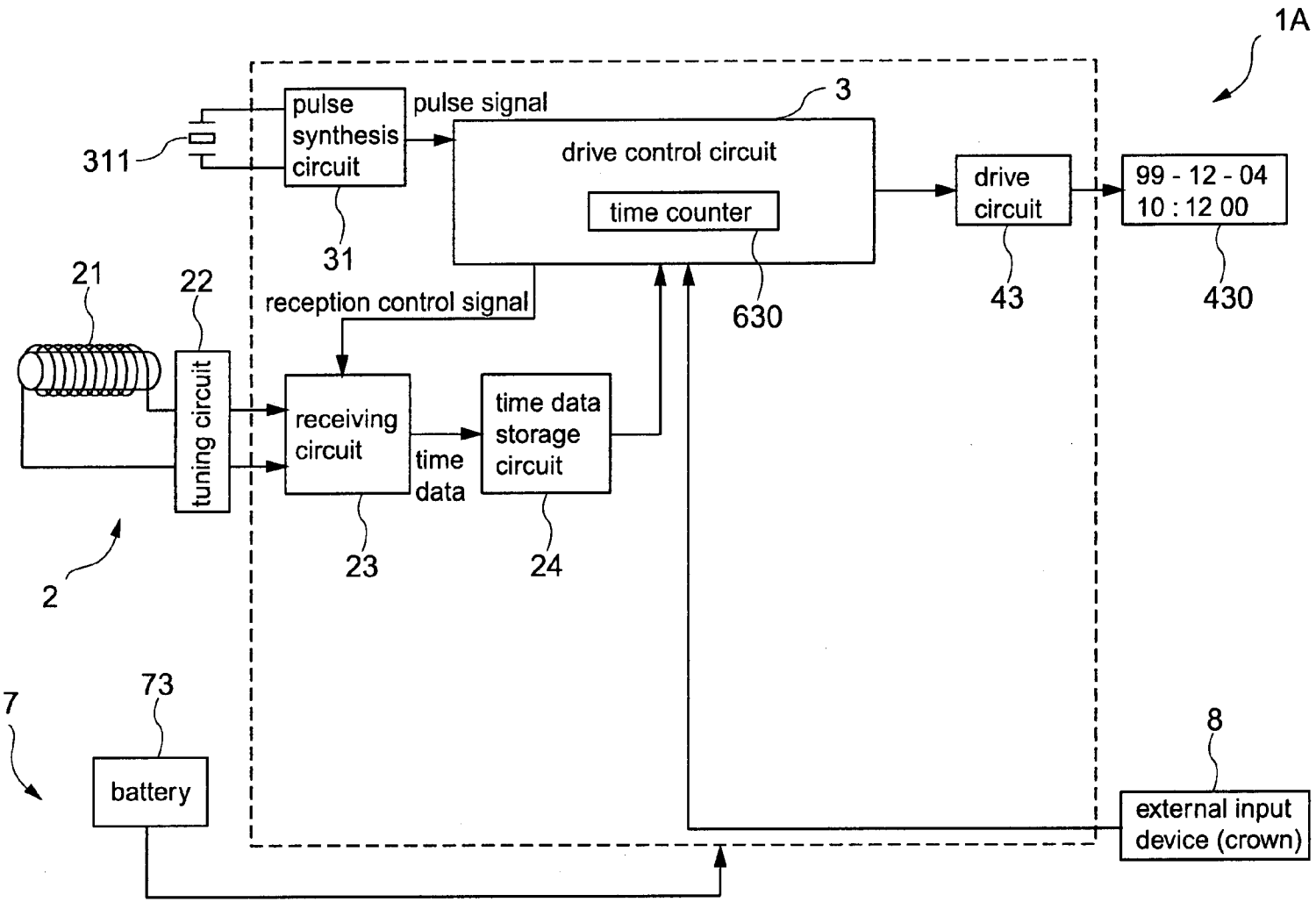
FIG. 19 is a block diagram showing a digital timepiece according to another implementation of the present invention.

The present invention shall also not be limited to an analog style radio-controlled watch 1, and can obviously be applied to a digital radio-controlled watch 1A. Like an analog radio-controlled watch 1 according to the present invention described above, a digital radio-controlled watch 1A according to the present invention includes an antenna 21, receiving circuit 23, time data storage circuit 24, drive control circuit 3, pulse synthesis circuit 31, a battery 73 as the power supply 7, and a crown or other external input device 8 as shown in FIG. 19. In addition, a time counter 630 is rendered in the drive control circuit 3, and the time data from the time counter 630 is displayed by way of a LCD panel drive circuit 43 on a LCD panel 430 used as the time display.

The value of the time counter 630 changes according to the pulse signal from the pulse synthesis circuit 31, and if the time kept by the time counter 630 differs from the time received by the receiving circuit 23 and stored in the time data storage circuit 24, the time counter 630 is adjusted accordingly.

By rendering the end portions of the antenna 21 core along the inside surface 91A in this digital radio-controlled watch 1A according to the present invention, antenna characteristics can be improved and good reception can be achieved even if the case member 9 is metal as described in the foregoing embodiments.

Furthermore, because a digital watch can be manufactured from fewer parts than an analog watch, requiring mainly an LCD panel 430, circuit board, and battery 73, our invention affords an extremely thin digital radio-controlled watch 1A.

The antenna 21 and battery 72 are disposed on opposite sides the center point O in the embodiments described above, but the invention shall not be so limited and they could be closer together. The relative positions of the reference oscillator 311 and antenna 21 shall likewise not be limited to that described above, and, more particularly, the distance between the battery 72 or reference oscillator 311 and the antenna 21 can be less than distance W1.

Furthermore, when the core 211 is made from amorphous foil, the amorphous foil is formed in the shape of a plane circular arc, and the foil pieces are layered in the thickness direction of the timepiece 1 (that is, stacked vertically) to form the core 211 as shown in FIG. 2. However, the amorphous foil could be formed in the shape of plane rectangles which are then layered in the plane direction of the timepiece (that is, perpendicularly to the thickness direction of the timepiece, i.e., horizontally) to form the core. The individual amorphous foil leaves must be curved in this case, but because the amorphous foil is thin, the individual pieces can be curved easily. In addition, because the amorphous foil need not be formed in the shape of a plane circular arc and can be simply cut into plane rectangles, the amorphous foil leaves, and therefore the core, can be easily and efficiently manufactured.

Furthermore, the coil is wound to near both ends 211B of the core 211 in the foregoing embodiments, but the coil could be wound only to the middle portion of the core. As described above, however, it is preferable to wind the coil to near the ends of the core due to antenna characteristic and space efficiency considerations.

Yet further, the wireless information received by the antenna 21 shall not be limited to longwave standard time signals carrying time information. For example, radio signals carrying time information could be extremely low-power radio signals in the 300 MHz band, specified low-power radio signals in the 400 MHz band, or even Bluetooth signals in the 2.4 GHz band. Because of the high frequency of these signals, the coil 212 requires fewer turns and the antenna 21 can be made accordingly smaller.

Yet further, the invention shall not be limited to wireless communication using radio signals, and could be used for wireless communication using inductive coupling or electromagnetic induction. While inductive coupling and electromagnetic induction require the communicating devices to be in proximity, communication is possible through stainless steel and other nonmagnetic metal components, thus affording the use of metals such as stainless steel for the case in which the antenna is housed.

The wireless information communicated using the antenna 21 shall also not be limited to time information. For example, an IC card function could be incorporated in the radio-controlled watch 1, which could then be used to communicate train commuter pass information and prepaid IC card information.

If an appropriate IC chip and antenna are contained in the case member 9, for example, information could be exchanged as needed by simply holding the wristwatch sufficiently close to a wicket machine, building access control terminal, or various types of vending machines having compatible IC card functionality. Operability and convenience can be greatly improved in such applications because rather than inserting an IC card to the machine, the wrist on which the wristwatch is worn could be simply waved passed the machine.

The antenna 21 integrated into case member 9 as described in this invention can therefore be used for receive-only applications such as receiving a standard time signal, for send and receive applications for communicating information such as in RF tags having a contactless IC, or for send-only applications, and can therefore be chosen appropriately according to the type of electronic timepiece or other electronic device with an internal antenna according to the present invention.

An electronic device with an internal antenna according to the present invention shall not be limited to the foregoing radio-controlled timepiece, and can be applied to a variety of electronic devices, including devices having only an IC card function. Examples of such electronic devices include instruments for measuring the pulse or body temperature, communication devices with a telephony function, PDAs having calendar, scheduling, and address book functions, portable computing devices with electronic calculator functions, AV devices with sound, picture, and video playback capabilities, personal information management devices having contactless communication function, and other types of electronic devices with a wireless information communication function.

These electronic devices could have a built-in LCD for displaying information received and externally transmitted via the antenna inside the case member 9. This information could include balance information and usage history information. User identification information could also be transmitted from the electronic device, and information could be provided to the user from the system communicating with the electronic device. This information could include, for example, messages sent to all users or a specific message (such as sale information or event information) sent to a specific person (identified by the user's ID) when the user gets on and off public transportation, enters and leaves a store or event hall, or arrives at and leaves work.

Furthermore, the antenna 21 shall is not limited to a loop antenna, and could be an inductive or other type of antenna. The type of antenna can be selected according to the type of information that is sent and received. In addition, when using a loop antenna, an antenna in which a magnetic core is not inserted could also be used.

While the invention has been described in conjunction With various embodiments, many further alternatives, modifications, variations and applications will be apparent to those skilled in the art in light of the foregoing description. Thus, the invention described herein is intended to embrace all such alternatives, modifications, variations and applications as may fall within the spirit and scope of the appended claims.

What is claimed is:

1. A radio-controlled timepiece, comprising:

a case member of which at least a portion is composed of metal, the case member having an inner curved surface;

an antenna, configured to receive information wirelessy-transmitted from an external source, disposed in the case member, the antenna including a core having two end portions and a coil wound around the core;

a receiver configured to process the wirelessly-received information;

a time display;

wherein the antenna is positioned in the case member with at least both end portions of the core disposed along, and subatantially aligned with, the inner curved surface of the case member; and two or more discrete capacitors that form a tuning circuit section for switching radio frequencies received by the antenna among the circuit elements that form a receiving circuit section are rendered only in the space enclosed by the core and the line segment connecting the center points of both ends of the antenna core.

2. A radio-controlled timepiece as descibed in claim 1, wherein the receiver comprises a plurality of circuit elements, at least some of which are disposed in a space defined by an inner surface of the antenna and an imaginary line extending between end surfaces of both end portions of the core.

3. A radio-controlled timepiece as described in claim 1, wherein the coil has two end portions that are disposed along the inner curved surface of the case member.

4. A radio-controlled timepiece as described in slaim 1, wherein the inner curved surface of the case member is a circular arc surface; and a planar shape of the core is in the form of a circular arc substantially concentric with the inner curved surface of the case member, and the core is disposed along the inner curved surface of the case member.

5. A radio-controlled timepiece as described in claim 1, wherein the inner curved surface of the case member is a circular arc surface;

the end portions of the core each have a planar shape in the form of a circular arc that is substantially concentric with the inner curved surface of the case member; and the core further includes a middle portion having a plannar shape in the form of a circular arc extending between the two end portions, the coil being wound around only the middle portion and a curbarure of the middle portion being less than a curvature of each of the end portions.

6. A radio-controlled timepiece as described in claim 1, wherein:

the inner curved surface of the case member is a circular arc surface;

the core has inside and outside curved contours and the end portions each have a planar shape substantially concintric with the inner curved surface of the case member;

the core further includes a middle portion having a planar shape in the form of a circular arc extending between the end portions, the coil being wound around only the middle portion; and the center of curvature of the outside contour of the middle portion is at a position farther from the portion than the center of curvature of the inside contour of the middle portion.

7. A radio-controlled timepiece as described in claim 1, wherein each end portion of the core has a planar shape that is substantially straight, and the core further includes a middle portion between the end portions.

8. A radio-controlled timepiece as described in claim 1, wherein the coil has two end surfaces and the angle defined by imaginary line segments extending from midpoints on the respective coil end surfaces to the center point of the inner curved surface of the case member is 60 degrees or more.

9. A radio-controlled timepiece as described in claim 1, wherein the inner curved surface of the case member is a circular surface; and the angle of intersection between a widthwise center line substantially perpendicular to an end surface of one end oirtion of the core and a tangent to the inside circumferential surface at a point on the inner curved surface where a radial line parallel to an end surface of the one end portion and extending from the fadial center of the inner curved surface intersects the inner curved surface is in the range of about 0 degrees to about +/−30 degrees.

10. A radio-controlled timepiece as described in claim 1, wherein the core is composed of a magnetic material of layered amorphpus foil.

11. A radio-controlled timepiece as described in claim 1, further comprising a battery for supplying power, wherein the antenna is disposed opposite the battery with the center of the inner curved surface of the case member therebetween.

* * * * *

UNITED STATES PATENT AND TRADEMARK OFFICE

CERTIFICATE OF CORRECTION

PATENT NO. : 7,280,438 B2
APPLICATION NO. : 10/897686
DATED : October 9, 2007
INVENTOR(S) : Teruhiko Fujisawa It is certified that error appears in the above-identified patent and that said Letters Patent is hereby corrected as shown below:

Column 24

Line 36 please change “information wirelessy-” to --information wirelessly- --

Line 45 please change “subantially” to --substantially--

Line 62 change “slaim” to --claim--

Column 25

Line 11 change “plannar shape” to --planar shape--

Line 13 change “a curbarure of” to --a curvature of--

Line 22 change “concintric” to --concentric--

Line 29 change “farther from the portion” to --farther from the middle portion--

Column 26

Line 16 change “oirtion” to --portion--

Line 19 change “fadial” to --radial--

Line 25 change “amporphpus” to --amorphous--

Signed and Sealed this

Third Day of June, 2008

JON W. DUDAS
*Director of the United States Patent and Trademark Office*